US011249420B2

(12) United States Patent
Erickson et al.

(10) Patent No.: US 11,249,420 B2
(45) Date of Patent: Feb. 15, 2022

(54) TONER CARTRIDGE INTERFACE MECHANISM AND METHODS FOR SAME

(71) Applicant: Katun Corporation, Minneapolis, MN (US)

(72) Inventors: Terry Dean Erickson, St. Paul, MN (US); Joseph Allen Amberg, Chanhassen, MN (US); Ryan Bayliss, Bloomington, MN (US)

(73) Assignee: Katun Corporation, Minneapolis, MN (US)

( * ) Notice: Subject to any disclaimer, the term of this patent is extended or adjusted under 35 U.S.C. 154(b) by 0 days.

(21) Appl. No.: 17/065,401

(22) Filed: Oct. 7, 2020

(65) Prior Publication Data

US 2021/0103233 A1 Apr. 8, 2021

Related U.S. Application Data

(60) Provisional application No. 62/911,841, filed on Oct. 7, 2019.

(51) Int. Cl.
*G03G 15/08* (2006.01)
*G03G 21/16* (2006.01)

(52) U.S. Cl.
CPC ..... *G03G 15/0867* (2013.01); *G03G 15/0886* (2013.01); *G03G 21/1676* (2013.01); *G03G 2215/0668* (2013.01)

(58) Field of Classification Search
CPC ..... G03G 15/0867; G03G 15/0872; G03G 15/0886; G03G 21/1676; G03G 2215/0663; G03G 2215/0665; G03G 2215/0668
See application file for complete search history.

(56) References Cited

U.S. PATENT DOCUMENTS

| | | | | |
|---|---|---|---|---|
| 5,890,040 | A * | 3/1999 | Matsuoka | G03G 15/0868 399/262 |
| 7,720,417 | B2 * | 5/2010 | Taguchi | G03G 15/0872 399/258 |
| 2012/0195645 | A1 * | 8/2012 | Takami | G03G 15/0886 399/262 |
| 2014/0064794 | A1 * | 3/2014 | Takahashi | G03G 15/0872 399/262 |
| 2016/0091819 | A1 * | 3/2016 | Shinozaki | G03G 15/0872 399/262 |
| 2019/0204777 | A1 * | 7/2019 | Yamaoka | G03G 15/0886 |
| 2020/0310293 | A1 * | 10/2020 | Nakai | G03G 15/0872 |

* cited by examiner

*Primary Examiner* — Sophia S Chen
(74) *Attorney, Agent, or Firm* — Schwegman Lundberg & Woessner, P.A.

(57) ABSTRACT

A toner cartridge includes a cartridge body having a dispensing port. An interface mechanism is coupled with the cartridge body. The interface mechanism includes at least one detent movably coupled with the cartridge body. The at least one detent includes a retaining surface, a shuttle surface and a bias element coupled with the detent. At least one detent guide is coupled with the cartridge body, and the at least one detent guide includes a guide channel aligned with the retaining surface. The cartridge body is configured for installation in an image forming apparatus between intermediate and fully installed configurations. In the intermediate installed configuration a feature of the image forming apparatus is within the guide channel and the shuttle surface depresses the detent. In the fully installed configuration the bias element deploys the retaining surface into intercepting alignment with the feature.

27 Claims, 18 Drawing Sheets

TONER CARTRIDGE INTERFACE MECHANISM AND METHODS FOR SAME

PRIORITY APPLICATION

This application claims priority to U.S. Provisional Application Ser. No. 62/911,841, filed Oct. 7, 2019, the disclosure of which is incorporated herein in its entirety by reference.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever. The following notice applies to the software and data as described below and in the drawings that form a part of this document: Copyright Katun Corporation, Minneapolis Minn. All Rights Reserved.

TECHNICAL FIELD

This document pertains generally, but not by way of limitation, to toner cartridges including developer or toner cartridges.

BACKGROUND

Image forming apparatuses including photocopiers, printers or the like include one or more reservoirs for consumable toner, ink, developer or the like. In some examples the reservoirs are supplied by cartridges removably installed in the systems. For example, in a multi-color image forming apparatus a plurality of cartridges including one or more of black, cyan, magenta and yellow toner are installed in corresponding cartridge receivers of the image forming apparatus. Image forming apparatuses include one or more retaining features configured to hold the cartridges in respective specified positions in the cartridge receivers, for instance to align discharge ports of the cartridges with the corresponding reservoir ports of the apparatuses. The retaining features include deflectable prongs, projections, detents, locking bars or the like. In some examples, the installation of a cartridge deforms the retaining features including an associated biasing element. With the cartridge fully installed the retaining features deploy from the deformed position and lock against features on the toner cartridge. Biasing elements, such as springs, living hinges or the like, deploy the retaining features. The deployed retaining features of the image forming system hold the installed cartridge in place, and thereby ensure components, such as discharge ports and reservoir ports are aligned.

SUMMARY

The present inventors have recognized, among other things, that a problem to be solved can include minimizing wear of an image forming apparatus at the cartridge receiver while at the same time releasably coupling toner cartridges in a manner that facilitates removal without undesirably ejecting the cartridge. In example image forming apparatuses one or more toner cartridges (including developer or toner cartridges) are replaceably installed in cartridge receivers having a complementary profile to the toner cartridges. An example image forming apparatus includes retaining features (e.g., latch mechanisms) configured to engage with corresponding features of the toner cartridge and hold the toner cartridge in an installed position. In the installed position a toner discharge port of the cartridge is aligned with a reservoir port of an image forming apparatus reservoir. In other examples, features including drive components, memory or the like of the image forming apparatus and the toner cartridge are aligned and maintained in alignment with the retaining features.

In some examples, the retaining features of the image forming apparatus wear over time and fail to reliably retain the toner cartridge in the installed position. Instead, the toner discharge port misaligns with a corresponding reservoir port of the image forming apparatus, and in some circumstances the misalignment facilitates spilling of toner or poor supply of toner to the image forming apparatus. In other examples, drive components, memory or other features of the toner cartridge fail to align with corresponding features of the image forming apparatus.

Optionally, the retaining features initially hold the toner cartridge in the installed position. Over time, the latch mechanism weakens or becomes over compliant. In some image forming machines, the cartridge receiver includes a biasing element such as a spring loaded plunger, compression spring or the like configured to eject the toner cartridge with light hand pressure that overcomes the latching force of a new latch mechanism. However, worn latch mechanisms fail to retain the toner cartridge, and accordingly when a machine door, locking bar or the like is released the toner cartridge unpredictably ejects from the image forming machine. In some examples, the ejecting cartridge spills toner in the machine and on nearby flooring or personnel.

The present subject matter can help provide a solution to this problem with a toner cartridge including the interface mechanism for coupling and decoupling with an image forming apparatus. As describe herein the toner cartridge includes at least one movable detent that is onboard the cartridge body. The detent is movable through engagement of the detent with a corresponding image forming feature of the image forming apparatus. The detent includes a shuttle surface, and the shuttle surface facilitates depression and bypassing of the image forming feature during installation. A biasing element deploys the detent from the depressed position and positions a retaining surface of the detent in an intercepting alignment with the image forming feature.

Because the interface mechanism is provided with the toner cartridge application of force to one or more associated detents provides minimal risk of wear or fracture type complications present with repeatedly loaded image forming machine associated locking claws. Instead, because the toner cartridge described herein is installed and decoupled a limited number of times (e.g., once or a limited plurality of instances after refilling) and the detents accordingly experience minimal wear or damage. Further, because the detents experience minimal wear, in some examples, the detents are provided with more 'aggressive' angles or minimized tapers. For example, the retaining surfaces of the detents optionally extend at a right angle to a cartridge longitudinal axis or includes a reverse taper (hook) or the like to enhance retention of the cartridge in the fully installed configuration. Because the cartridge is installed and decoupled a limited number of times the detents (even with enhanced angles or minimized tapers) reliably deflect and decouple without appreciable wear or failure.

This overview is intended to provide an overview of subject matter of the present patent application. It is not intended to provide an exclusive or exhaustive explanation of the invention. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
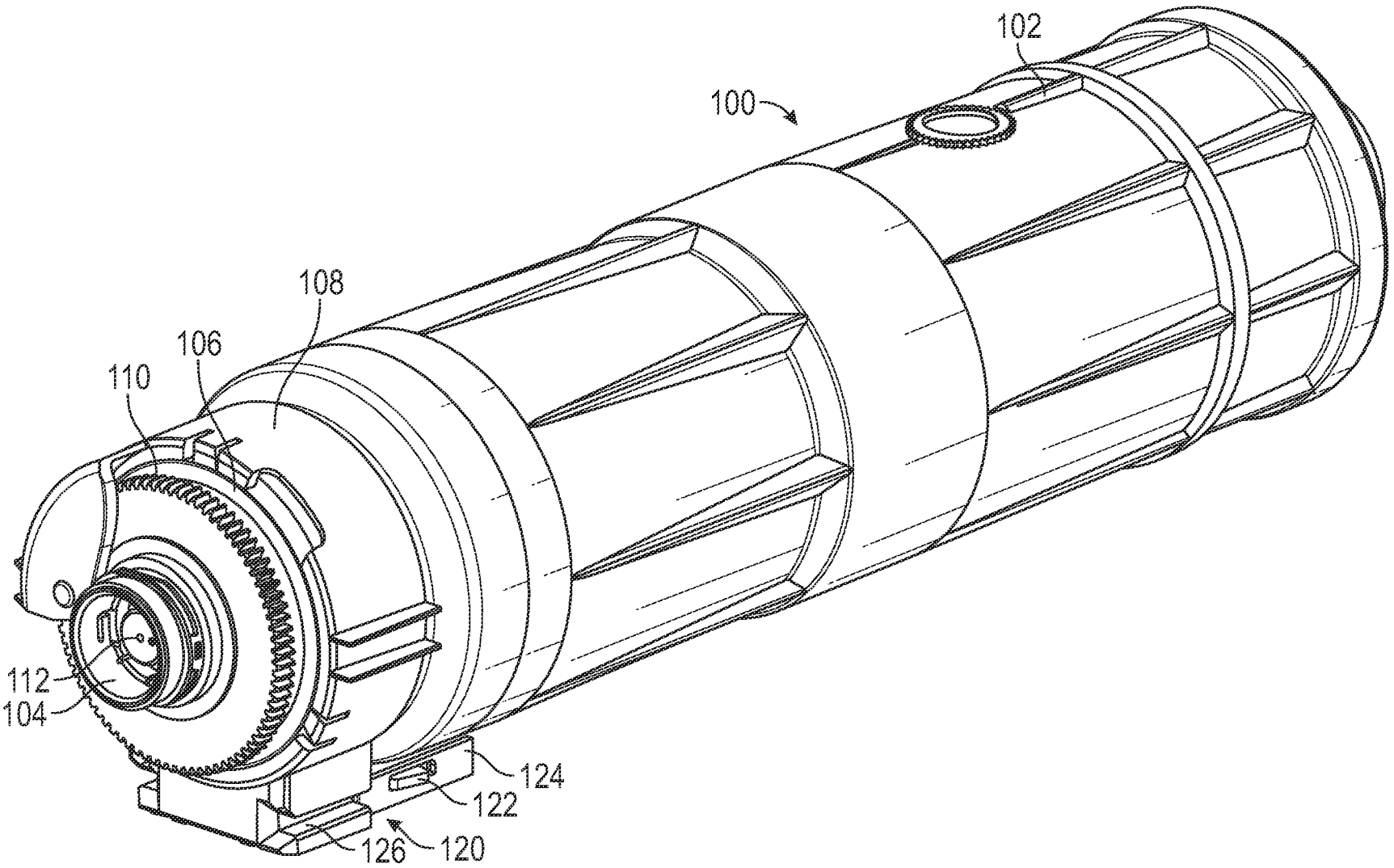
FIG. 1 is a perspective view of one example of a toner cartridge including an interface mechanism.

FIG. 1 is a perspective view of one example of a toner cartridge 100. The toner cartridge 100 shown includes a cartridge body 102 having a cartridge cap 106. In one example, the cartridge cap 106 is integral to or fixed with the cartridge body 102. In another example, the cartridge cap 106 is rotatable relative to the cartridge body 102. The cartridge cap 106, in this example, includes a dispensing port 104 selectively closed with a dispensing shutter 112. The dispensing shutter 112 includes a plunger, piston or the like seated within the dispensing port 104 and, in one example, biased toward a closed position. The cartridge body 102 is rotatable and includes one or more of baffles, helical ridges, angled ridges, drives or the like therein to accordingly move a particulate material such as toner, developer or the like in the cartridge body 102 toward the dispensing port 104.

As further shown in FIG. 1, the toner cartridge 100, in one example, includes an interface collar 108. As described herein, the interface collar 108 provides one or more features such as an interface mechanism 120 configured to selectively retain the toner cartridge 100 in an installed position within an image forming apparatus. As described herein, the interface mechanism 120 includes in various examples one or more detents 122 that cooperate with detent guides 126 of the interface mechanism 120 to reliably deliver one or more corresponding features of the image forming apparatus such as image forming features including, but, not limited to, ridges, projections or the like in an aligned position to the detents 122 to selectively retain the cartridge 100 in the installed position within the image forming apparatus.

As further shown in FIG. 1, the cartridge body 102 and the cartridge cap 106 are rotatable through a drive coupling 110 coupled with the cartridge cap 106. With installation of the toner cartridge 100 in an image forming apparatus, one or more corresponding drive features engage with the drive coupling 110 (e.g., a gear, cog, deformable fitting such as rubber or the like) to transmit rotation to the drive coupling 110 and the cartridge body 102. Rotation of the cartridge body 102 rotates toner within the cartridge body 102. As the toner accrues along the walls of the cartridge body 102 and falls according to rotation and gravity baffles, drive mechanisms or the like within the cartridge body 102 move the toner (or other particulate matter including, for instance, a developer or the like) toward the dispensing port 104.

Referring again to FIG. 1, in one example, the dispensing shutter 112 associated with the dispensing port 104 is automatically opened, for instance, by engagement with a feature of the image forming apparatus including, for instance, a plunger, projection, suction nozzle or the like delivered through the dispensing port 104. The feature of the image forming apparatus deflects or depresses the dispensing shutter 112 into an opening configuration to open the toner cartridge 100. In one example, the installation of the toner cartridge 100 automatically positions a toner removal nozzle of the image forming apparatus through the dispensing port 104. As described herein, the interface mechanism 120 including, for instance, detents 122 and detent guides 126 ensure one or more features of the image forming apparatus are engaged with the detents 122 to selectively retain the toner cartridge 100 in the installed configuration to accordingly maintain the dispensing port 104 and the dispensing shutter 112 in an open configuration to facilitate removal of toner.

Figure 2:
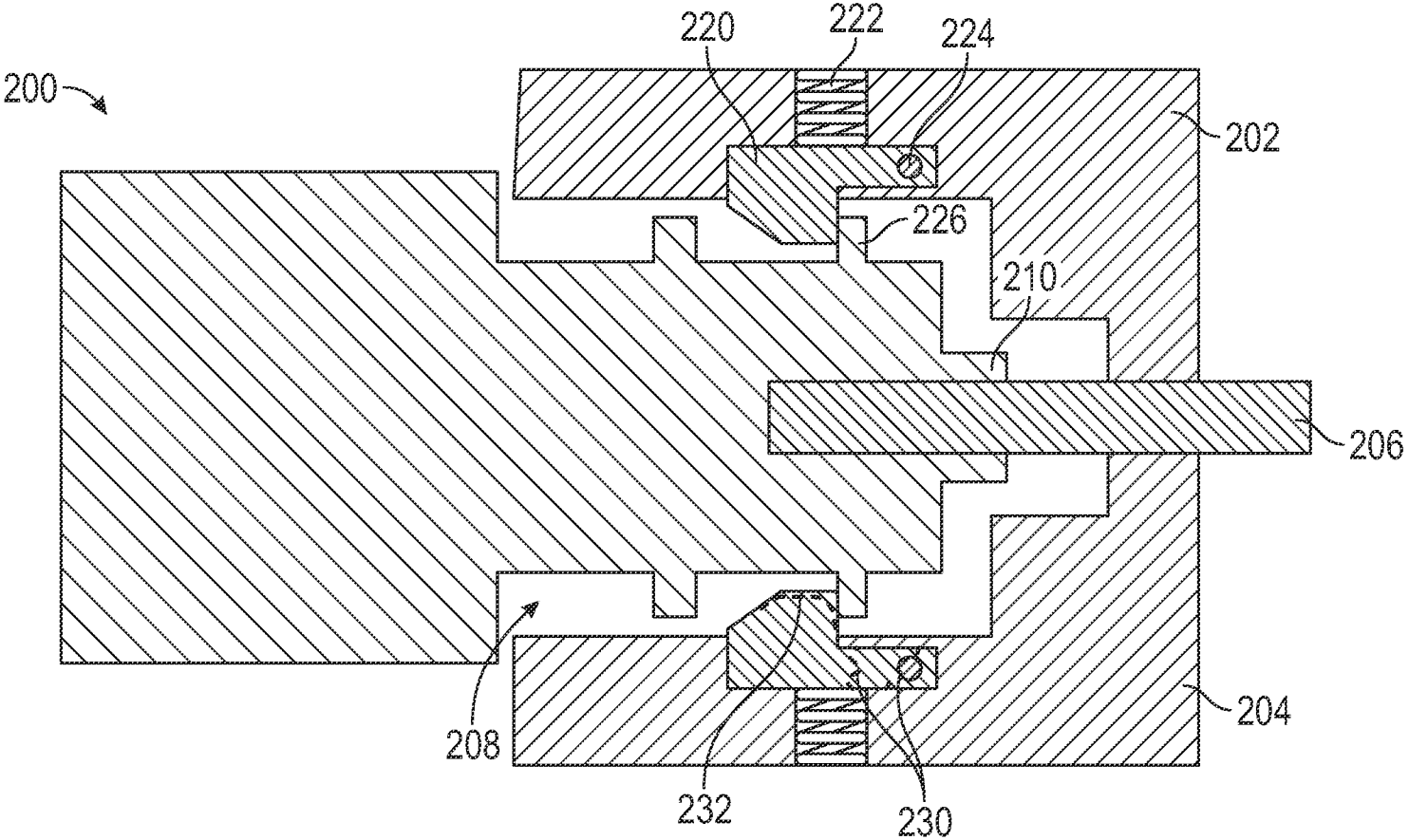
FIG. 2 is a schematic view of one example of an image forming apparatus cartridge receiver including a cartridge retaining mechanism.

FIG. 2 is a schematic view of another example of a toner cartridge 200 in an installed position with an image forming apparatus 202. As shown, the image forming apparatus 202 includes a cartridge receiver 204 having a receiver socket 208 configured for reception of a portion of the toner cartridge 200 therein. The portion of the toner cartridge 200 shown includes a discharge port 210 provided at a similar position to the toner cartridge 100. The discharge port 210 is configured to receive a suction nozzle of the image forming apparatus 202.

As further shown in FIG. 2, the toner cartridge 200 is received in a reusable locking assembly, including one or more locking claws 220 biased by one or more operating elements 222 into engagement with a corresponding portion of the toner cartridge 200, in this example, a cartridge flange 226. The cartridge flange 226 is, in one example, a ring, ridge or the like extending around the cartridge 200 (e.g., extends around the discharge port 210 along a perimeter of the cartridge). As shown, each of the locking claws 220, in this example, are pivotably coupled at a pivot 224. Additionally, the operating element 222, including one or more of a linkage, biasing element or the like, moves the locking claw 220 into interfering engagement with the cartridge flange 226 to accordingly create an engagement that holds the toner cartridge 200 within the receiver socket 208. For instance, during installation the imaging forming apparatus 202, including the locking claw 220, deflects and engages against the cartridge flange 226 of the toner cartridge 200 to hold the toner cartridge in the installed position shown in FIG. 2.

When decoupling of the toner cartridge 200 is specified, in one example, an operator pulls on the toner cartridge 200. This triggers release of the locking claw 220, for instance, with one or more instruments or the like configured to measure an increase in force on the toner cartridge 200 or locking claw 220 based on manual pulling by the operator. The operating element 222, in this example, releases the locking claws 220 and allows for deflection of the locking claws 220, for instance, by way of sliding engagement between the locking claw 220 and the cartridge flange 226. The toner cartridge 200 is removed from the receiver socket 208 to prepare the image forming apparatus 202 for the delivery of another toner cartridge 200. Accordingly, the image forming apparatus 202 shown, for instance, in FIG. 2, including its locking claws 220, operating elements 222, pivots 224 or the like are subjected to repeated cycling as toner cartridges 200 are repeatedly installed and decoupled.

As further shown in FIG. 2 by way of dashed lines on the lower locking claw 220, with repeated use, including installation and decoupling of toner cartridges 200 from the image forming apparatus 202, one or more of wear, fracture or the like are caused on one or more surfaces or components of the locking claw 220. For instance, with the repeated loading, contact, striking, sliding movement or the like of the cartridge flange 226 and other components of toner cartridges 200 over the locking claws 220, wear 232 is caused along the engaging surfaces of the locking claw 220. One or more fractures 230, in another example, occur across one or more components of the locking claw 220 or the like. Fractures 230 or wear 232 of the locking claws 220 decrease the retaining force of the locking claws 220 and frustrate the retention of the toner cartridge 200 by the image forming apparatus 202. Poor or failed retention of the cartridge 200 in some examples, causes misalignment between the cartridge 200 and the apparatus 202, poor delivery of toner, spills or the like between the toner cartridge 200 and the cartridge receiver 204 of the apparatus 202. Further, with ongoing bias applied between the intake nozzle 206 and a biasing element, for instance, provided in the discharge shutter to prompt automatic closure of the toner cartridge 200, the toner cartridge 200 is, in some examples, errantly ejected, decoupled or the like from the receiver socket 208. Accordingly, errant ejection or decoupling, misalignment or the like increases the risk of spilling, poor delivery of toner to the image forming apparatus 202 or the like.

Figure 3:
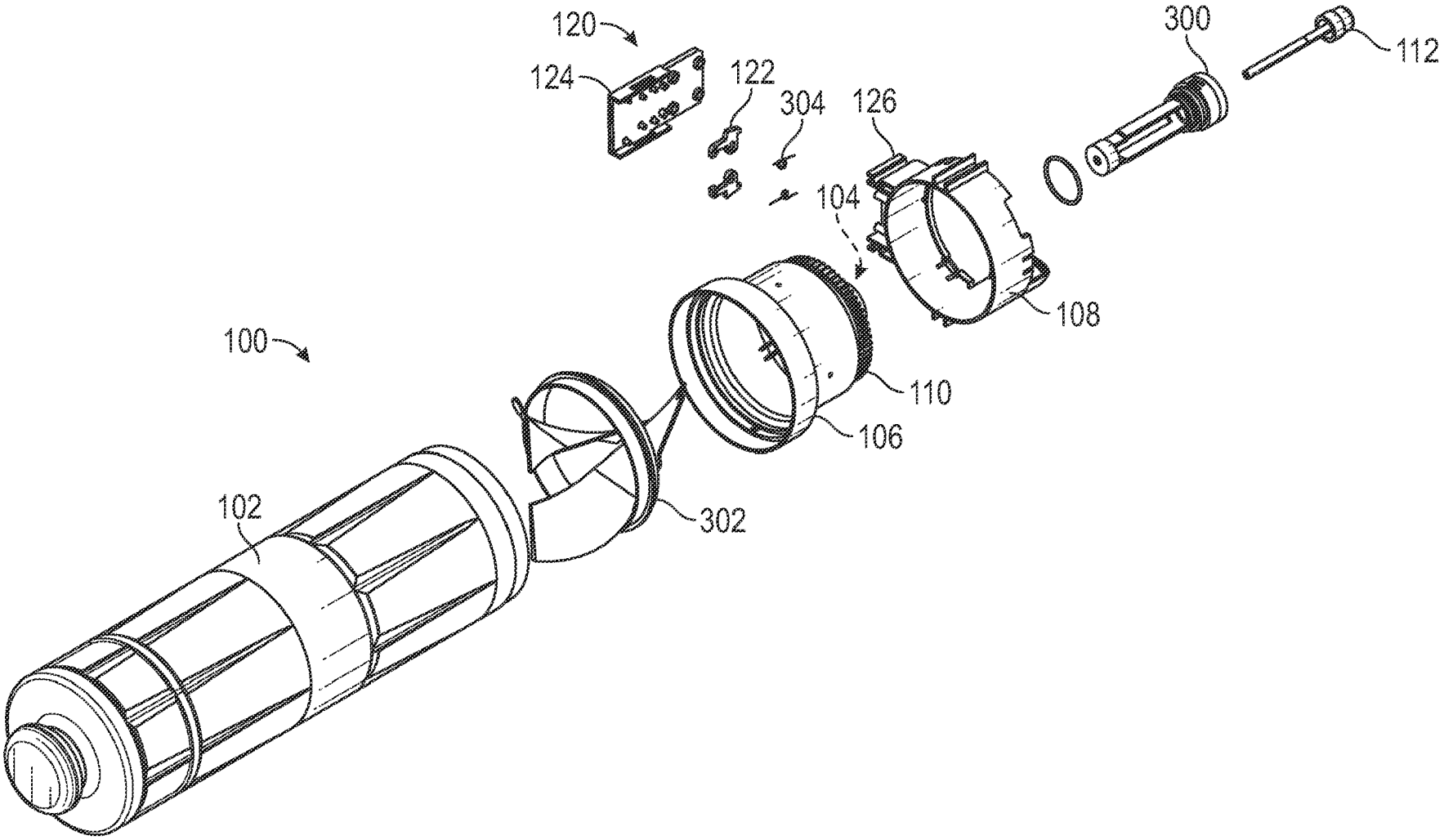
FIG. 3 is an exploded view of the toner cartridge shown in FIG. 1.

FIG. 3 shows an exploded view of the toner cartridge 100 previously shown in FIG. 1. In the example shown in FIG. 3, the components of the toner cartridge 100 are in an axial alignment, for instance, with the dispensing shutter 112 provided at one end of FIG. 3 and the cartridge body 102 provided at the opposed end of the figure. As shown in FIG. 3, the cartridge body 102, in this example, includes the cartridge cap 106 optionally separable relative to the cartridge body 102. As further shown in FIG. 3, a transport baffle 302 (e.g., a helical spiral, paddles, fitting or the like) is configured for coupling between the cartridge cap 106 and the cartridge body 102. As further shown in FIG. 3, the cartridge cap 106, in this example, includes the drive coupling 116. With the cartridge cap 106 coupled with the cartridge body 102 (and the transport baffle 302 therein) rotation of the drive coupling 110 is transmitted through the drive cap 106 to the cartridge body 102 to accordingly rotate the cartridge body and toner therein, for instance, for driving by way of the transport baffle 302 (and optionally angled or helical ridges in the cartridge body) toward the dispensing port 104.

As further shown in FIG. 3, the cartridge cap 106 is rotatable relative to the interface collar 108. For instance, as shown, the interface collar 108 has a complimentary inner profile relative to an exterior profile of the cartridge cap 106. Accordingly, the cartridge cap 106 and the cartridge body 102 are configured for rotation relative to the interface collar 108. As further shown in FIG. 3, the interface collar 108, in this example, includes a component of an interface mechanism, such as the interface mechanism 120, including, for instance, one or more detent guides 126 provided on either side of a projecting portion of the interface collar 108.

As further shown in FIG. 3, the toner cartridge 100 includes a dispensing shutter 112. The dispensing shutter 112 is configured for reception and movement with a shutter guide 300. Optionally, the shutter guide 300 includes one or more biasing elements such as coil springs, torsion springs, elastomers or the like configured to bias the dispensing shutter 112 toward a closed position when installed in the dispensing port 104. In one example, installation of the toner cartridge 100, as well as corresponding retention of the toner cartridge 100 in the installed configuration, automatically deflects the dispensing shutter 112, for instance, into a depressed configuration to accordingly open the dispensing port 104. The interface mechanism 120 maintains the toner cartridge 100 in the installed configuration and overcomes a biasing force, for instance, transmitted from the biasing element of the dispensing shutter 112 to the remainder of the cartridge 100 after installation. For instance, delivery of a nozzle, toner suction nozzle or the like into the dispensing port 104 depresses the dispensing shutter 112 and deflects the biasing element therein. In the absence of reliable interfacing with the image forming apparatus (provided by the interface mechanism 120) the toner cartridge 100 is moved by the bias from a right to left position relative to the orientation shown in FIG. 3 (or left to right in FIG. 1). The interface mechanism 120 described herein provides reliable retention, anchoring or the like of the toner cartridge 100 to counteract biasing force from the dispensing shutter 112 (as well as other components of the image forming apparatus) and accordingly maintains the cartridge body 102 and the remainder of the toner cartridge 100 in the installed configuration.

As further shown in FIG. 3, the interface mechanism 120 includes the mechanism housing 124 laterally exploded relative to the remainder of the toner cartridge 100. As shown, the mechanism housing 124 includes a series of posts, projections, recesses or the like configured to receive one or more detents such as the detents 122. In this example, the detents 122 are pivoting detents configured to at least partially project through the mechanism housing 124. As further shown in FIG. 3, one or more biasing elements 304, in this example torsion springs, are also shown. The biasing elements 304 couple with the mechanism housing 124 and the detents 122 and provide a returning bias to the detent 122 to reliably deploy the detent 122 through one or more ports of the mechanism housing 124 and into alignment with one or more of the detent guides 126 associated with the respective detents 122. As will be described herein, the detent guides 126 and the detents 122 cooperate. For instance, the detent guides 126 align and guide one more features of the image forming apparatus toward the detents 122 and ensure the aligned detents 122 are deflected, for instance, by the passage of the features of the image forming apparatus into a depressed configuration and thereafter deploy into a deployed configuration to accordingly seat the corresponding feature of the image forming apparatus behind the detent 122 and engage the detent 122 in a manner that the toner cartridge 100 is reliably seized or retained in place within the image forming apparatus.

Figure 4A:
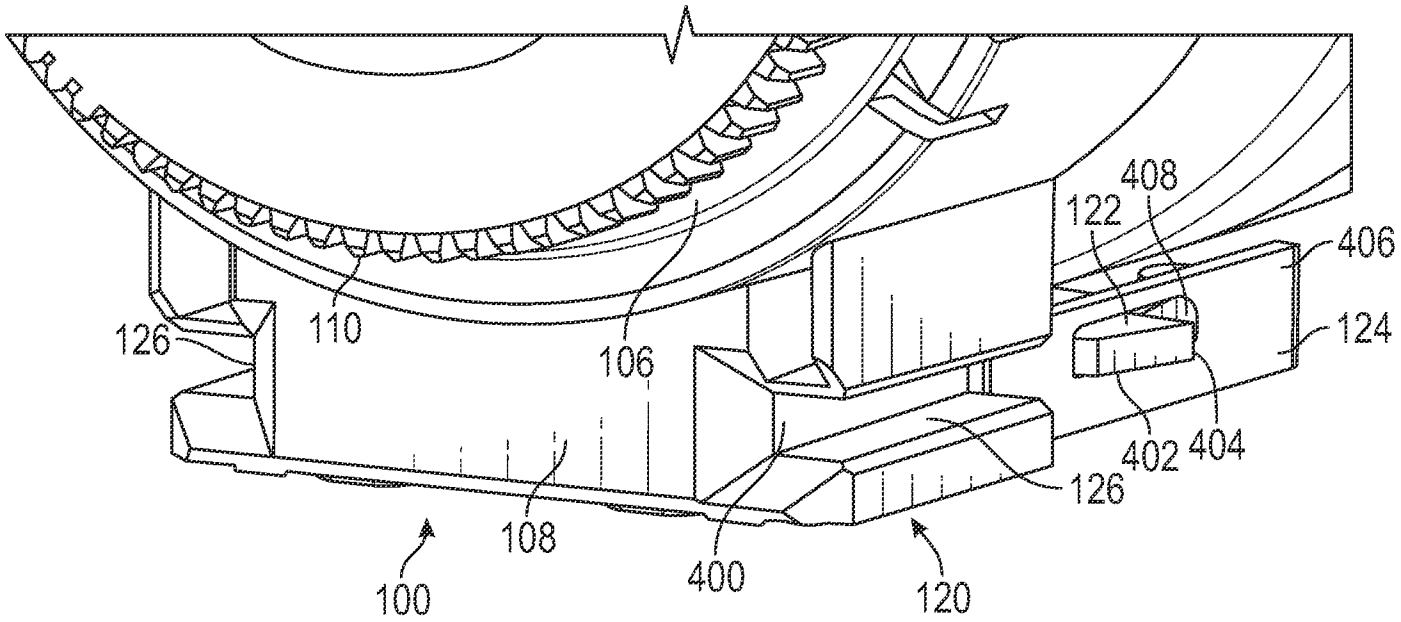
FIG. 4A is a detailed perspective view of the interface mechanism shown in FIG. 1.

FIG. 4A is a detailed perspective view of a portion of the toner cartridge 100. As shown, the toner cartridge 100, in FIG. 4A, includes a cartridge cap 106 coupled with the cartridge body 102 shown in FIG. 3. In this example, the interface collar 108 is provided around at least a portion of the cartridge cap 106. As previously described, the interface collar 108 is held static by way of engagement of one or more of the interface mechanism 120 including, for instance, the detent guides 126 and the detents 122 with corresponding features of the image forming apparatus. In contrast, the remainder of the toner cartridge 100 including the cartridge cap 106 and the cartridge body 102 are rotatable by way of the drive coupling 110 provided on the cartridge cap 106.

As previously described herein, the toner cartridge 100 is reliably retained in an installed position within the image forming apparatus with the interface mechanism 120. Referring again to FIG. 4A, the interface mechanism 120 includes, in this example, a detent guide 126 and the detent 122 as previously described herein. In this example, the interface mechanism 120 includes a plurality of detents 122 and associated detent guides 126. Referring first to the detent guide 126, as shown in FIG. 4A the detent guide 126 includes a guide channel 400 extending along the longitudinal axis of the toner cartridge 100. As further shown in FIG. 4A, the detent guide 126 is aligned with the detent 122. Similarly, the detent guide 126 on the opposed portion of the interface collar 108 (on the left side of FIG. 4A) includes a corresponding guide channel 400 aligned with a corresponding detent 122 on the other side of the collar 108. Optionally, each of the detent guides 126 includes a taper, funneled feature or the like configured to guide and align a corresponding feature of the image forming apparatus into the remainder of the detent guide 126 and facilitate alignment with the detent 122.

The interface mechanism 120, for instance, in the right portion of FIG. 4A includes the detent 122 moveably positioned relative to the remainder of the toner cartridge 100 including the mechanism housing 124. In an example, the mechanism housing 124 includes one or more pins, slots, guides or the like configured to guide movement of the detent 122, for instance, between the deployed position shown in FIG. 4A and a depressed position, for instance, with a portion of the detent 122 recessed within the mechanism housing 124, while the toner cartridge 100 is installed in an image forming apparatus. The mechanism housing 124, in this example, includes one or more housing flanges 406 provided on either side of the interface collar 108. The housing flange 406 includes a detent slot 408 configured to facilitate passage of a portion of the detent 122 through the detent slot 408. Optionally, the detent slot 408, in one example, cooperates with one or more other features of the interface mechanism, for instance, guide slots, pins or the like to constrain movement of the detent 122 between the deployed position shown in FIG. 4A and the depressed position. For instance, a component of the detent 122, such as a projection, flange or the like, engages with a portion of the housing flange 406 surrounding the detent slot 408.

Referring again to FIG. 4A, the detent 122 includes one or more surfaces to facilitate installation and retention of the toner cartridge 100. In this example, the detent includes a shuttle surface 402 and a retaining surface 404 provided at an opposed side of the detent 122 relative to the shuttle surface 402. Each of the retaining surface 404 and the shuttle surface 402 are in alignment with the detent guide 126 including the guide channel 400. As further shown in FIG. 4A and further shown herein, the shuttle surface 402, in one example, includes a greater taper relative to the retaining surface 404. The shuttle surface 402 facilitates the passage or shuttling of one or more components of the image forming apparatus including, but not limited to, ribs, ridges, projections or the like overtop of the detent 122. The detent 122 deflects with the passage of these features, for instance, with engagement along the shuttle surface 402 and the features move behind the detent 122. After passage of these features, the detent 122 returns to the deployed configuration shown in FIG. 4A, for instance, according to bias provided by the biasing elements 304 shown in FIG. 3. The retaining surface 404 is at a steeper angle and conversely includes a lesser taper (including no taper) relative to the shuttle surface 402. The deployed retaining surface 404 is proximate to the features of the image forming apparatus including one or more of, but not limited to, ridges, projections or the like. The steeper angle of the retaining surface 404 promotes retention of the toner cartridge 100 in the fully installed configuration in the image forming apparatus.

For example, a bias supplied to the toner cartridge 100, for instance by way of a bias at the dispensing shutter 112 from a biasing element therein is opposed by the retaining force provided by the retaining surface 404 engaged with the corresponding portion of the image forming apparatus. Accordingly, the detent 122 having the retaining surface 404 retains the toner cartridge 100 in the fully installed configuration and facilitates the continued and reliable alignment of features of the toner cartridge 100, such as the dispensing port 104, with the image forming apparatus (e.g., an intake nozzle or the like). Additionally, the interface mechanism 120 retains the toner cartridge 100 in position within the image forming apparatus and minimizes (e.g., decreases or eliminates) the risk of an unintended decoupling of the toner cartridge 100 from the image forming apparatus and corresponding spills, misalignments or the like between the toner cartridge 100 and the image forming apparatus.

In one example, the retaining surface 404, as previously described herein, has a steeper angle relative to the shuttle surface 402 or conversely less of a taper compared to the shuttle surface 402. The retaining surface 404 thereby readily retains the toner cartridge 100 in place. In another example, the retaining surface 400, while including a steeper angle relative to the shuttle surface 402, includes some (smaller) taper to facilitate the deflection of the detent 122, for instance, with pulling of the cartridge 100 to decouple from the image forming apparatus. Accordingly, with the bias provided, for instance, by the biasing element associated with the dispensing port and supplemental force provided by an operator removing the toner cartridge 100, the retaining force provided by the retaining surface 400 is overcome, the detent 122 depresses or rotates (e.g., assisted in one example by moderate taper of the retaining surface 404) and the toner cartridge 100 is allowed to decouple from the image forming apparatus.

In another example, the retaining surface 404 includes a surface extending at a right angle or reverse taper, for instance, to provide a hooking engagement with the corresponding portion of the image forming apparatus. In this example, manual operation of the toner cartridge 100 to decouple the cartridge from the image forming apparatus, in one example, facilitates the depression of the detent 122 including one or more of rotation, translation or the like based on the force applied to the retaining surface 404 from the corresponding engagement between the image forming apparatus and the retaining surface 404. Accordingly, the detent 122 deflects out of alignment with the feature of the image forming apparatus to facilitate the removal of the toner cartridge 100. Because the interface mechanism 120 is provided with the toner cartridge 100 the application of force to the detents 122 provides minimal risk of wear or fracture type complications for the detents 122 as is otherwise the case with an image forming apparatus based locking claw. Instead, because the toner cartridge 100 is installed and decoupled a limited number of times (e.g., once or a limited plurality of instances after refilling) the detents 122 experience minimal wear or damage. Further, because the detents 122 experience minimal wear, in some examples, the detents 122 are provided with more 'aggressive' angles or minimized tapers relative to the retaining surface 404 shown in FIG. 4A (or FIG. 4B). For example, the retaining surface 404 optionally extends at a right angle to the cartridge axis, includes a reverse taper (hook) or the like to enhance retention of the cartridge 100 in the fully installed configuration. Because the cartridge 100 is installed and decoupled a limited number of times the detent 122, even with enhanced angles or minimized tapers, reliably deflects when decoupled without appreciate wear or failure.

In the example shown in FIG. 4A, the interface mechanism 120 includes the detents 122 and detent guides 126 in opposed positions along the interface collar 108, for instance along the projecting portion of the interface collar relative to the remaining ring shaped portion. In other examples, the detents and detent guides described herein are staggered or offset relative to each other. For instance, the detents and detent guides are positioned at differing axial positions along the toner cartridge, different perimeter positions along the interface collar 108 or similar component or the like.

Figure 4B:
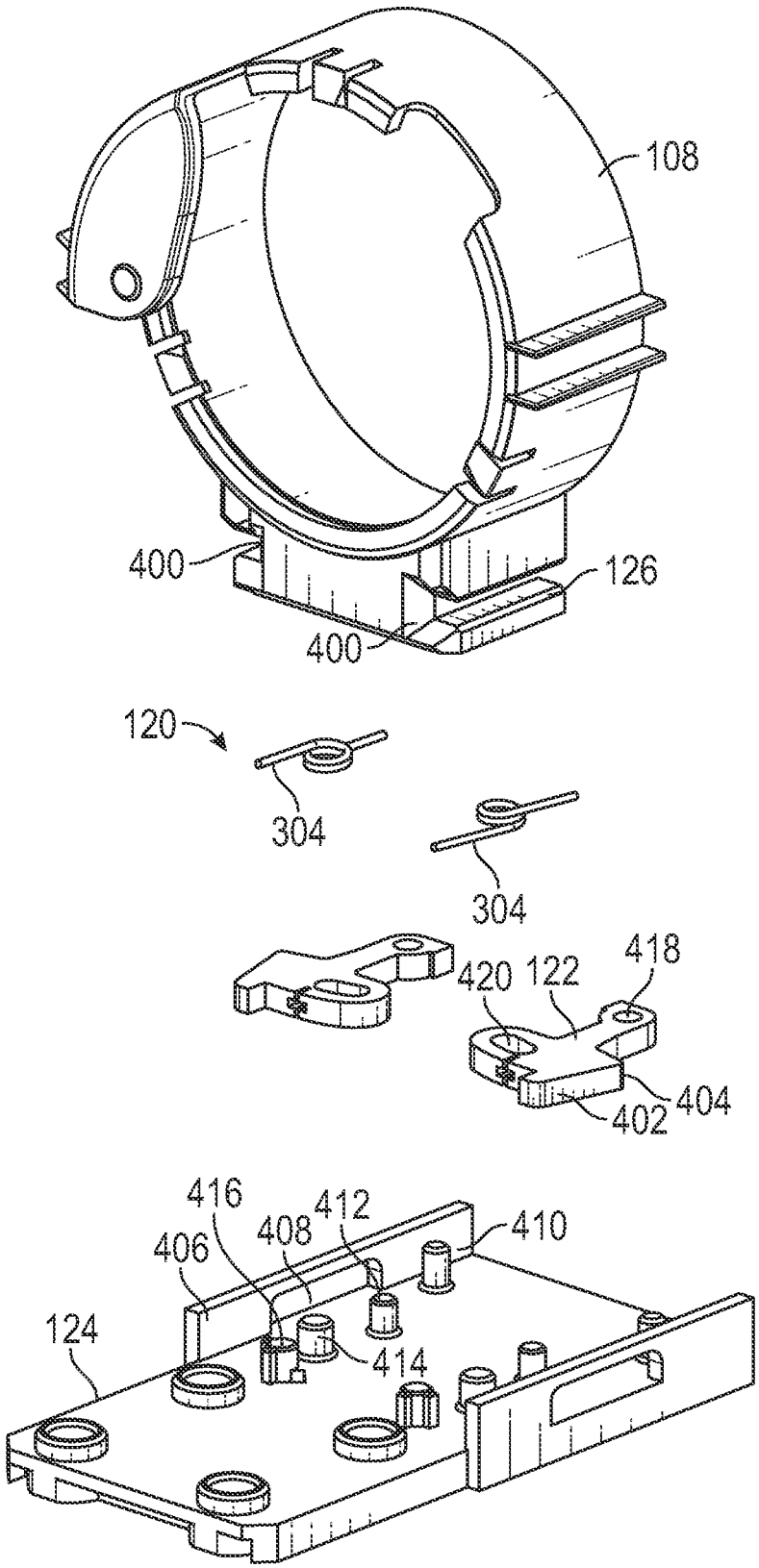
FIG. 4B is an exploded view of the interface mechanism and a portion of the cartridge body shown in FIG. 1.

FIG. 4B shows a detailed exploded view of the interface mechanism 120 previously described and shown in FIG. 4A. In this example, the interface collar 108 is decoupled relative to the remainder of the toner cartridge 100. The interface mechanism 120, including the mechanism housing 124, detents 122 and biasing elements 304, are shown below the interface collar 108. Referring first to the mechanism housing 124, the mechanism housing is shown with one or more housing flanges 406 including corresponding detent slots 408. As previously described, portions of the detents 122 including, but not limited to, the retaining surface 404 and shuttle surface 402 project through the detent slot 408 with the detent 122 in the deployed position.

As further shown in FIG. 4B, the mechanism housing 124 further includes a biasing element pin 414, for instance, for each of the biasing elements 304. In this example, the biasing elements 304 include one or more torsion springs including, springs having the looped portions shown in FIG. 4B. The looped portions of the biasing elements 304 are positioned over the biasing element pins 414 to accordingly anchor the biasing elements 304 in position proximate to the detents 122. As further shown in FIG. 4B, the interface mechanism 120 includes one or more loading pins 416 provided in proximity to the biasing element pins 414. The loading pins 416, in one example, engage with or couple with free ends of the biasing elements 304 to load the elements 304 for biasing of the detents 122.

As further shown in FIG. 4B, the detents 122 each include a pivot hub 418 and a deployment guide 420. In the exploded view, the pivot pin 410 is passed through the pivot hub 418 to rotatably couple the detent 122 with the mechanism housing 124. Conversely, the deployment guide 420, in this example, a slot, rail or the like provided with the detent 122 is coupled around the guide pin 412. The guide pin 412 accordingly constrains movement of the detent 122, for instance, according to the profile of the deployment guide 420. Stated another way, one or more of the depressed position, deployed position, intervening movement between or the like of the detent 122 is constrained or controlled by the deployment guide 420 in combination with the guide pin 412 (as well as rotation about the pivot pin 410 at the pivot hub 418).

Figure 4C:
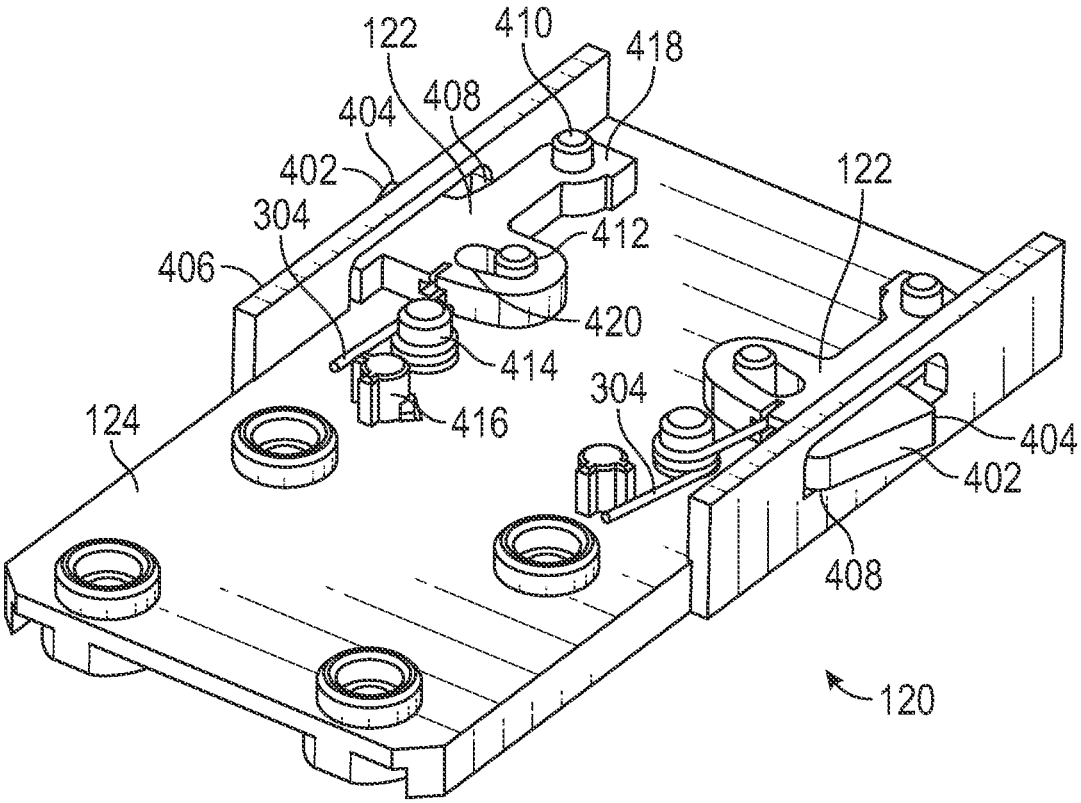
FIG. 4C is a perspective view of a portion of the interface mechanism of FIG. 4B assembled.

FIG. 4C is a detailed perspective view of the interface mechanism 120 with each of the detents 122 and the biasing elements 304 installed along the mechanism housing 124. As shown in FIG. 4C, each of the retaining surface 404 and the shuttle surface 402 of each of the detents 122 projects, in this example, through the detent slot 408. With depression of the detents 122, one or more of the shuttle surface 402 or the retaining surface 404 are correspondingly depressed into the mechanism housing 124, for instance, to misalign the detents 122 with one or more corresponding features of the image forming apparatus during installation of the toner cartridge.

As shown in FIG. 4C, the biasing element 304 is installed and coupled with the mechanism housing 124 and the detent 122. For instance, a first opposed end of the biasing element 304 is coupled with the loading pin 416 on either side of the mechanism housing 124. The biasing element 304 is received over the biasing element pin 414. A second opposed end of the biasing element 304 is coupled with a corresponding slot, recess, fitting or the like provided with the detent 122. This arrangement is duplicated, in this example, on the opposed side of the mechanism housing 124 to accordingly provide biased detents 122 projecting from each of the detent slots 408.

As further shown in FIG. 4C, the detents 122 are in a deployed position relative to the mechanism housing 124 including, for instance, the respective housing flanges 406. As shown, the guide pin 412 is positioned within the deployment guide 420 (in this example a slot) while the pivot pin 410 is positioned within the pivot hub 418 of the detent 122. The guide pin 412, in cooperation with the deployment guide 420, constrains movement of the detent 122, for instance, to the deployed position shown in FIG. 4C. Conversely, the deployment guide 420 constrains movement of the detent 122 into a depressed position, for instance, according to the limit of travel of the guide pin 412 within the moving deployment guide 420. Depression of the detents 122 is opposed by the one or more biasing elements 414. Accordingly, with passage of the shuttle surface 402 beyond the corresponding feature of the image forming apparatus (e.g. a rib, projection, flange or the like), the biasing elements 304 move the depressed detent 122, in this example, through rotation about the pivot pin 410 to return to the deployed position shown in FIG. 4C.

Referring again to FIG. 4C, the interface mechanism 120 is shown with the detents 122 in the deployed position. For instance, the biasing elements 304 are configured to bias the shuttle surface 402 and returning surface 404 of the detent 122 through the corresponding detent slots 408 of the mechanism housing 124. In the example shown in FIG. 4C, the pivot pin and pivot hub 410, 418 are provided at an opposed portion of the detent 122 relative to the engaging end of the biasing element 304 to the detent 122. For instance, as shown, the biasing element 304 is coupled with the detent 122 proximate to and into the detent 122 having the shuttle surface 402. Conversely, the pivot pin 410 and the pivot hub 418 are provided at an opposed end of the detent 122. With this arrangement, the detent 122 is reliably biased toward the deployed position. Further, the biasing element 304 is moved out of the translation range of the detent 122 while still providing the bias for movement. Instead, the biasing element 304 is provided on an opposed side of the deployment guide 420 and guide pin 412 relative to the pivot pin 410 and pivot hub 418. Stated another way, the pivot pin and pivot hub 410, 418 are provided at an opposed end of the detent 122 relative to the location of coupling between the detent 122 and the biasing element 304.

Figure 5A:
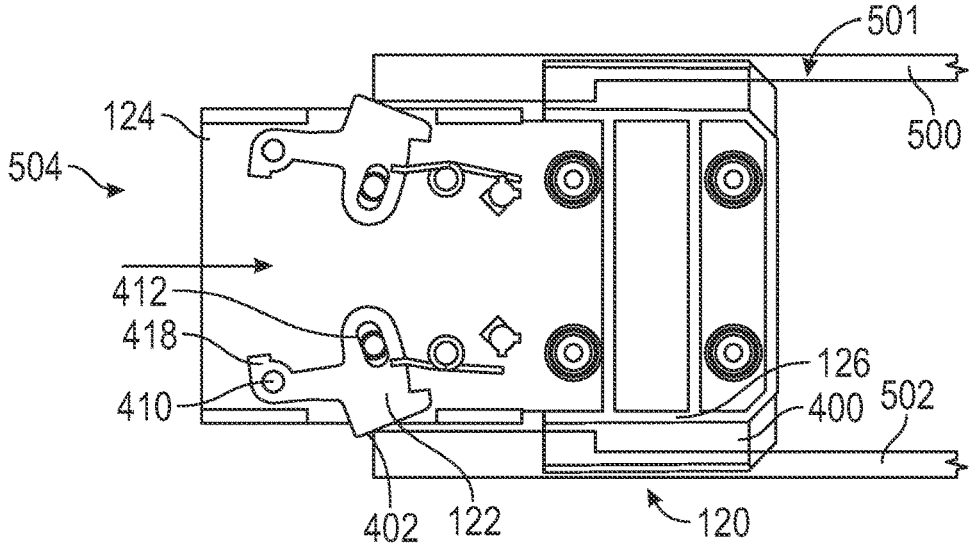
FIG. 5A is a schematic view of the toner cartridge of FIG. 1 in an intermediate installed configuration.

Additionally, the guide pin 412 and deployment guide 420, in this example, a channel, groove or the like provided in the detent 122 are configured to constrain movement of the detent 122, for instance, between the deployed position shown in FIG. 4C and the depressed position shown, for instance, in FIG. 5A. In one example, the deployment guide 420 and guide pin 412 cooperate to minimize striking of the detent 122 with one or more corresponding features of the interface mechanism 120, the toner cartridge 100 generally or the image forming apparatus such as the image forming apparatus 500 shown herein. Accordingly, the guide pin 412 and deployment guide 420, in one example, cooperate to protect one or more features of the toner cartridge 100 and the image forming apparatus 500 by a constraining motion and corresponding movement of the detents 122 to the specified deployed and depressed positions.

Figure 5B:
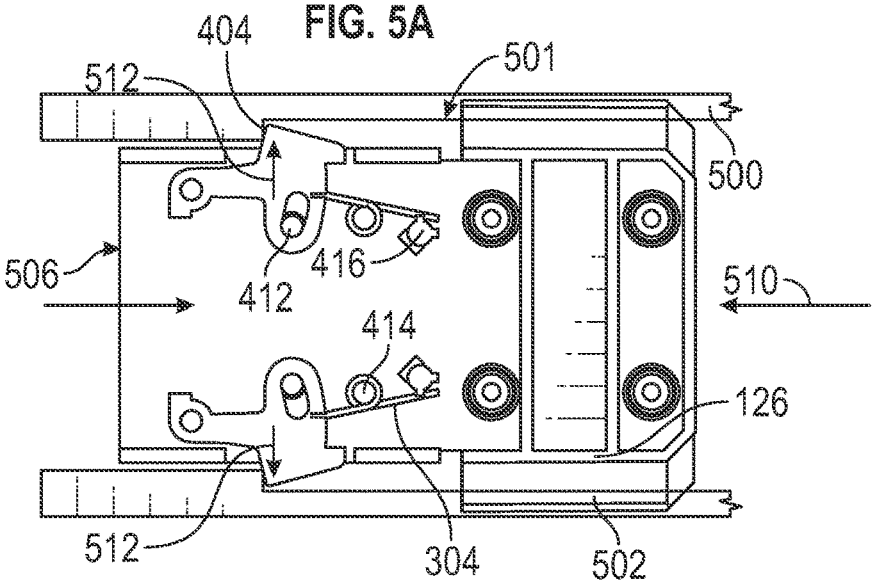
FIG. 5B is a schematic view of the toner cartridge of FIG. 1 in a fully installed configuration.
Figure 5C:
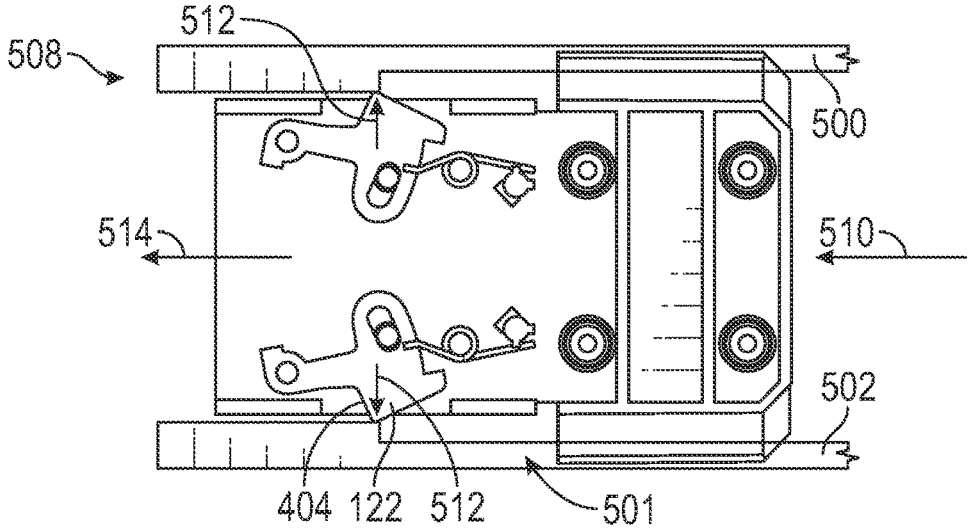
FIG. 5C is a schematic view of the toner cartridge of FIG. 1 in a withdrawn configuration.

FIGS. 5A, 5B and 5C show an example interface mechanism 120 previously described and shown herein in each of an intermediate installed configuration 504, a fully installed configuration 506 and a decoupling configuration 508 relative to a cartridge receiver 501 of an image forming apparatus. Referring first to FIG. 5A, the interface mechanism 120 is shown in the intermediate installed configuration 504. For instance, the mechanism housing 124, including the detents 122, is shown partially installed in an image forming apparatus 500 having an image forming feature 502 (e.g., ridge, rib, protrusion, recess or the like) and including the cartridge receiver 501. In this example, the image forming apparatus 500 includes opposed image forming features 502 including, but not limited to, ridges, ribs, protrusions, recesses or the like configured to interact with the detents 122.

As previously described, the interface mechanism 120 includes detent guides 126 including, for example, guide channels 400, configured to receive the image forming feature 502 therein. Additionally, the detent guides 126 guide the image forming features 502 into alignment with the detents 122. As shown, for instance, in FIG. 5A, the detent guides 126 receive the image forming features 502 and the image forming features are delivered in an aligned fashion toward the detent 122. In this example, the arrangement is duplicated on the opposed side of the mechanism housing 124 with the opposed detent 122 and corresponding image forming feature 502. In other examples, the arrangement is duplicated in a staggered fashion, for instance with the opposed detent 122 and detent guide 126 positioned at a location proximal or distal (along the axis of the cartridge), radially spaced around the perimeter of the cartridge or the like.

As shown in FIG. 5A, the image forming feature 502 is engaged with the shuttle surface 402 of the detent 122 of the toner cartridge 100. The tapered profile of the shuttle surface 402 facilitates the passage of the image forming feature 502 over the detent 122. The detent 122 accordingly depresses, for instance, into the depressed position shown in FIG. 5A to facilitate passage of the image forming feature 502 past the retaining surface 404 shown, for instance, in FIG. 5B.

In the example shown in FIG. 5A, the detent 122 is rotatably coupled with the remainder of the interface mechanism 120 including, in this example, the mechanism housing 124. For instance, the detent 122 is pivotably coupled about a pivot hub 418 that receives the pivot pin 410, in this example, extending from the mechanism housing 124. Depression of the detent 122 includes rotation of the detent 122, for instance, into the configuration 504 shown in FIG. 5A. In other examples, depression of the detent 122 includes translation of the detent, for instance, laterally relative to one or more features of the interface mechanism 120, one or more of the image forming features 502 or the like.

Referring now to FIG. 5B, the toner cartridge 100, including the interface mechanism 120, is shown in a fully installed configuration 506 relative to the cartridge receiver 501 of the image forming apparatus 500. As shown, the detents 122 are in the deployed position previously shown in FIGS. 4A-C with the retaining surfaces 404 in close proximity to the corresponding portions of the image forming features 502. For instance, the retaining surfaces are in intercepting alignment with ridges, ribs, protrusions, recess edges or the like. In this configuration, the engagement between the retaining surface 404 relative to the image forming apparatus 500 (e.g., a feature 502 such as a rib, projection, ridge, edge of a recess or the like) retains the toner cartridge 100 in the fully installed configuration. Stated another way, the bias provided, in one example, by the biasing elements 304 moves the detents 122 relative to the intermediate installed configuration 504 to the deployed position shown with the fully installed configuration 506. The retaining surfaces 404, in this example, extending at a right angle or a steeper angle relative to the taper of the shuttle surfaces 404 and retain the toner cartridge 100 in the fully installed configuration 506. In the fulling installed configuration 506, the interface mechanism 120 maintains alignment between features of the toner cartridge and one or more corresponding features of the image forming apparatus, for instance, an intake nozzle of the image forming apparatus and the dispensing port of the toner cartridge 100; one or more memory features, identification features or the like of the toner cartridge 100 and a reader of the image forming apparatus 500; or the like. Additionally, the retention of the toner cartridge 100 in the fully installed configuration 506 minimizes (e.g., reduces, minimizes, eliminates or the like) the risk of spilling, misalignment or the like between the toner cartridge 100 and the image forming apparatus 500.

FIG. 5C shows the toner cartridge 100 including the interface mechanism 120 in a decoupling configuration 508, for instance, during removal of the toner cartridge 100 from the image forming apparatus 500. In this example, the operator optionally pulls on the toner cartridge 100 applying sufficient force (e.g., a supplemental bias 514) to overcome a retaining bias 512 (of the detents) and initiate deflection of the detents 122, for instance, into the position shown in FIG. 5C. The detents 122 are depressed, for instance, by way of engagement between the retaining surface 404 with the image forming features 502 on either side of the interface mechanism 120. The detents 122 are deflected into the depressed position shown in FIG. 5C to accordingly allow removal of the toner cartridge 100 from the image forming apparatus 500.

In one example, the force or motion applied by the operator to the toner cartridge 100 (e.g., supplemental bias 514) optionally in combination with the bias provided by one or more biasing elements (e.g., an ejection bias 510), for instance, a biasing element associated with the dispensing shutter, is sufficient to overcome the engagement between the retaining surface 404, the corresponding feature of the image forming feature 502 as well as the bias provided by the biasing elements 304 associated with the detents 122 (e.g., the retaining bias 512). In various examples, the shape of the retaining surface 404 including, for instance, its taper, angle or the like relative to the shuttle surface 402 along with the bias provided by the biasing element 304 is tuned (e.g., controlled, modulated or the like) to ensure the toner cartridge 100 is retained in the fully installed configuration 506 shown in FIG. 5B. Additionally, the retaining force is, in one example, tuned (e.g., controlled, modulated or the like) to facilitate easy removal of the toner cartridge, for instance, by an operator pulling on the toner cartridge. The toner cartridge 100 with the interface mechanism 120 is thereby readily retained within the image forming apparatus 500 to facilitate enhanced alignment and retention of alignment while minimizing spills, leaks or the like between the toner cartridge 100 and image forming apparatus 500.

Figure 6A:
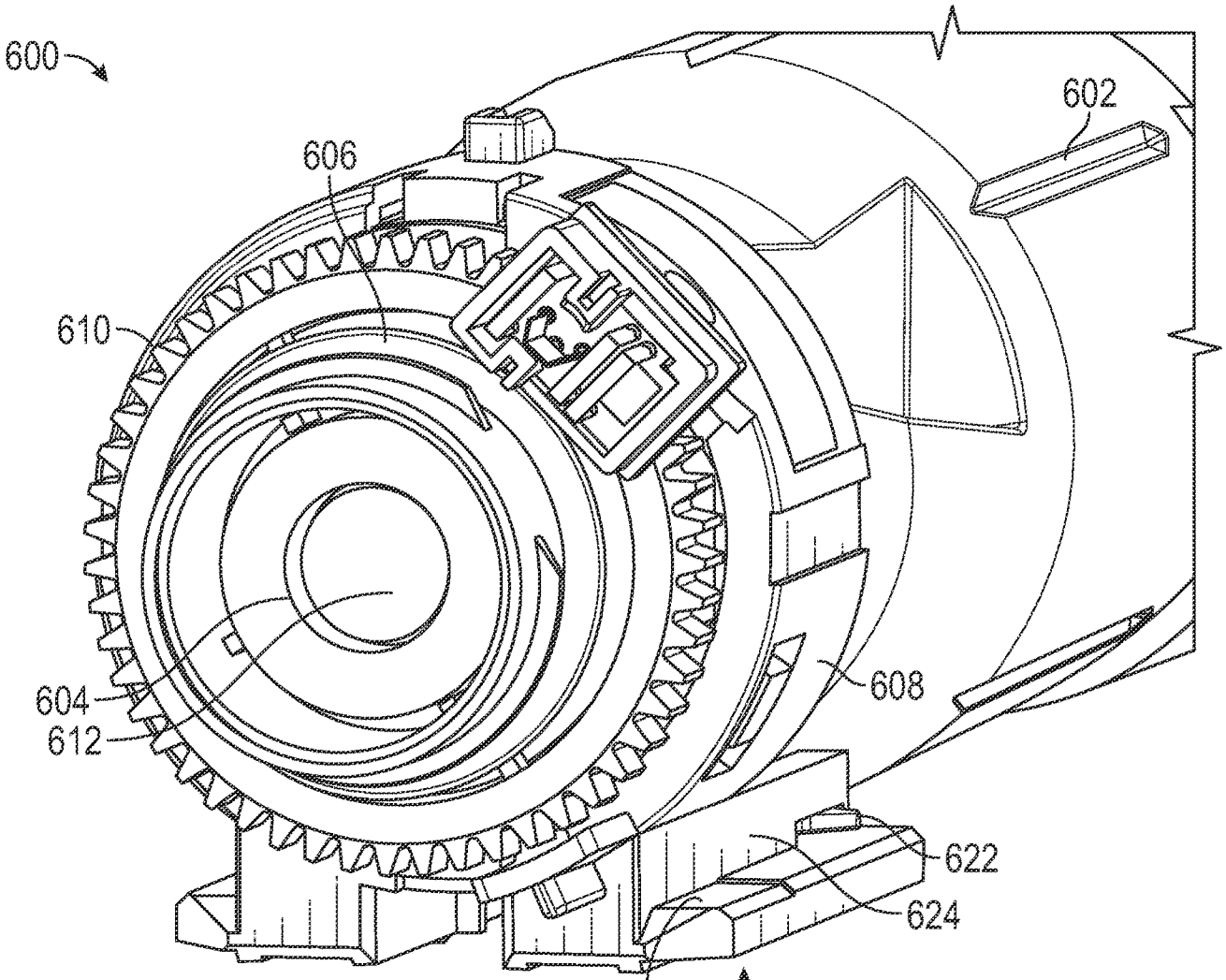
FIG. 6A is a detailed perspective view of another example of an interface mechanism.

FIG. 6A shows another example of a toner cartridge 600 having an interface mechanism 620. As shown, the toner cartridge 600 includes features similar in some regards to the previously described toner cartridge 100 shown, for instance, in FIG. 1. For instance, the toner cartridge 600 includes a cartridge body 602 rotatable relative to an interface collar 608. As further shown in FIG. 6A, the toner cartridge 600, for instance, the cartridge body 602 includes a cartridge cap 606 having a dispensing port 604 and a dispensing shutter 612 therein. The dispensing shutter 612 is, in one example, operated, for instance, depressed, opened or the like with installation of the toner cartridge 600 and a corresponding image forming apparatus. As further shown in FIG. 6A, a drive coupling 610 is coupled with the cartridge body 602, for instance, at the cartridge cap 606. Rotation of the cartridge body 602 is, in one example, accomplished through a driven engagement between the drive coupling 610 and one or more corresponding features, for instance, corresponding gear, felt or the like provided with the image forming apparatus and configured to rotate the cartridge body 602 at the drive coupling 610.

As further shown in FIG. 6A, the toner cartridge 600 includes an interface mechanism 620. The interface mechanism 620 includes, in this example, one or more detent guides 626, for instance, in this example, two detent guides provided at differing locations around the interface collar 608. The interface mechanism 620 further includes a mechanism housing 624 configured to retain one or more detent 622 therein. The detent 622, in this example, and similar to the example cartridge 100, shown in FIG. 1, position the detent 622 in alignment with the detent guide 626.

Figure 6B:
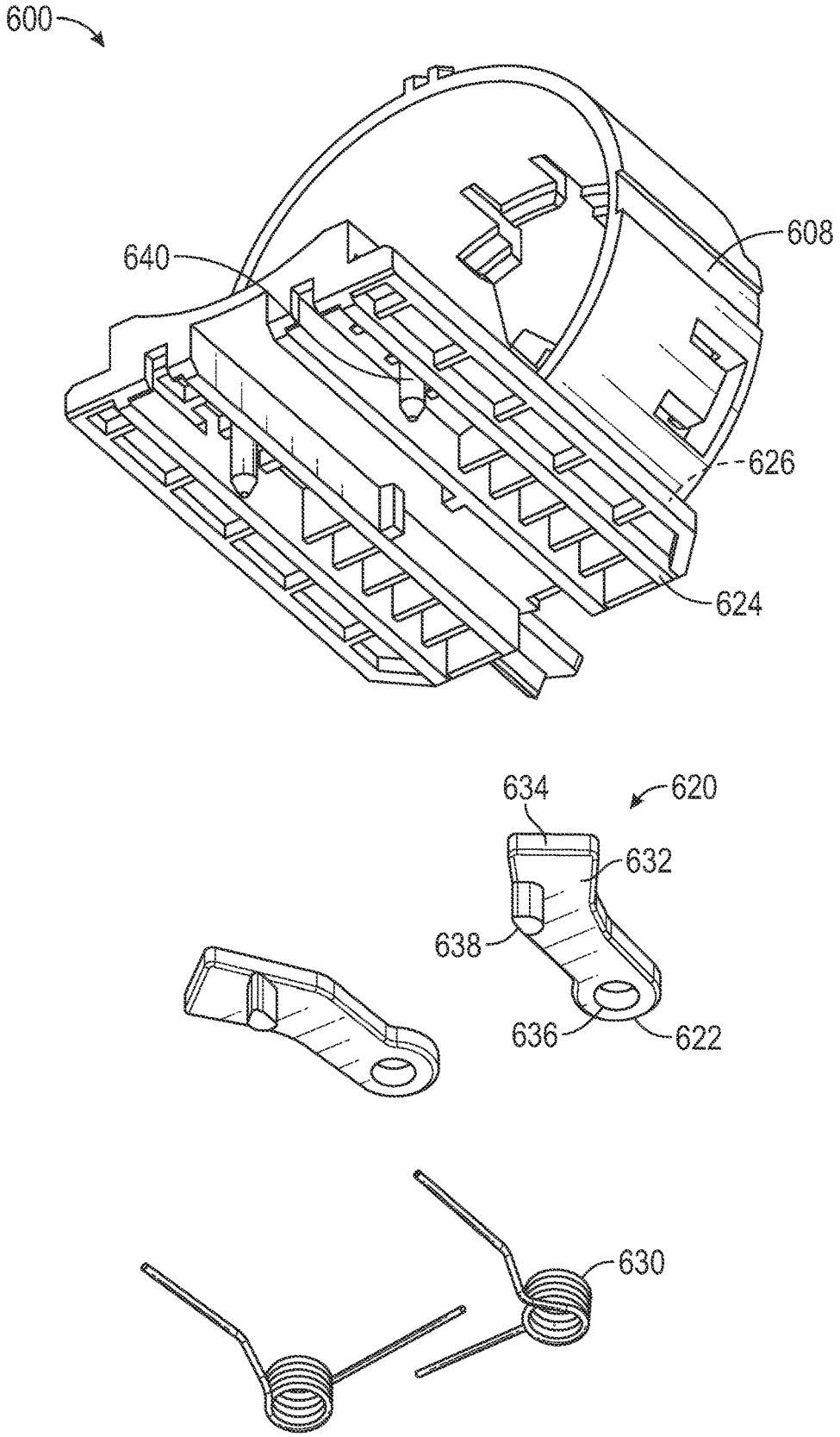
FIG. 6B is an exploded view of the interface mechanism of FIG. 6A and a portion of a cartridge body.

Referring now to FIG. 6B, a portion of the toner cartridge 600 is shown again in an exploded view. As shown, the interface collar 608 is shown in the upper portion of FIG. 6B while the detent 622 are shown exploded downwardly relative to the interface collar 608. Corresponding biasing elements 630 are shown below the detent 622 and configured for coupling with the detent 622 to accordingly provide a bias to facilitate the deployment of the detent 622, for instance, through a portion of the mechanism housing 624.

In the example shown in FIG. 6B, each of the detent 622, in this example, include a retaining surface 634 and a shuttle surface 632. In one example, the shuttle surface 632 has a taper greater than a taper of the retaining surface 634. For instance, the retaining surface 634 is, in one example, more steep, at a right angle or the like relative to the shuttle surface 632.

As further shown in FIG. 6B, the detent 622 includes a pivot hub 636 and, in this example, the detent 622 is configured to pivot, for instance, between deployed and depressed positions. Optionally, the detent 622 includes a biasing element flange 638 projecting from the remainder of the detent 622 and configured to engage or couple with a portion of one or more of the biasing element 630. In one example, the biasing element flange 638 is positioned proximate to one or more of the retaining surface 634, shuttle surface 632 or another location along the detent 622 to accordingly provide a rotational restoring force to the detent 622 to facilitate deployment of the detent 622 to the deployed position shown, for instance, in FIG. 6A. As shown in FIG. 6B, for instance, at the interface collar 608 and the mechanism housing 624, in one example, pivot pins 640 are provided for coupling with each of the detent 622, for instance, at the pivot hub 636. In this example, the interface mechanism 620 seats each of the biasing element 630 on one of the corresponding pivot pins 640. Accordingly, the rotation of the detent 622, as well as anchoring or coupling of the biasing element 630, is provided by the pivot pin 640.

Figure 6C:
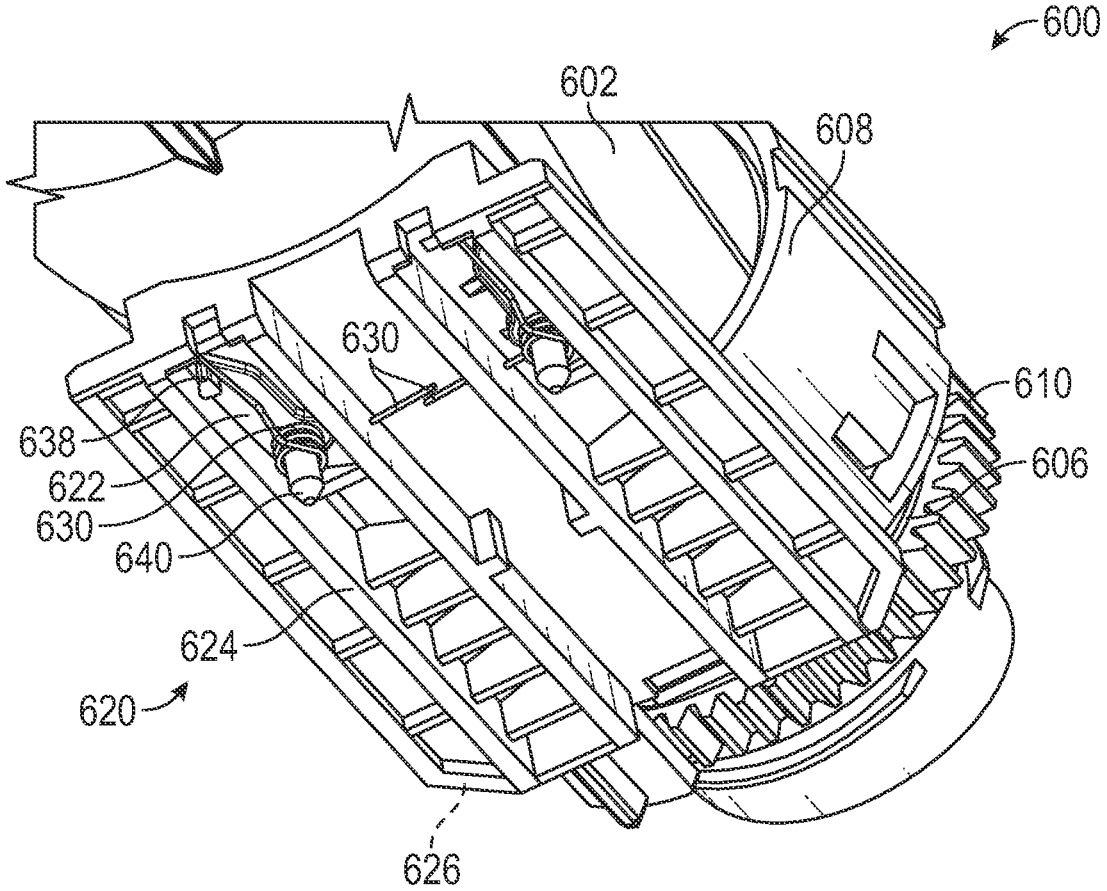
FIG. 6C is a perspective view of a portion of the interface mechanism of FIG. 6B assembled.

FIG. 6C shows a perspective view of the rear surface of the toner cartridge 602. As shown in FIG. 6C, the cartridge body 602 is received in the interface collar 608 and the interface collar 608 in turn provides the interface mechanism 620.

As previously described and shown in part in FIG. 6B, the pivot pin 640 extends from the mechanism housing 624 and each of the detent 622 and the biasing element 630 are coupled with the pivot pin 640. Accordingly, rotation of the detent 622 and deflection of the biasing element 630 are conducted about the pivot pin 640, in this example. An opposed end of the biasing element 630 is, as shown in FIG. 6C, coupled with the biasing element flange 638 of each of the detent 622.

With the arrangement shown in FIG. 6C, the biasing elements 630 bias the detents 622, for instance, including the shuttle surface 632 and retaining surface 634 into the deployed position shown, for instance, in FIG. 6A. Accordingly, the detent 622 is aligned with the detent guide 626. Accordingly, as the toner cartridge 600 is installed, one or more corresponding features of the image forming apparatus are passed along the detent guide 626 and in an aligned configuration relative to the detent 622. Accordingly, continued installation of the toner cartridge 600 deflects the detent 622 through engagement of the shuttle surface 632 with the corresponding portion of the image forming apparatus to depress each of the detent 622 and allow for fully installed positioning of the toner cartridge 600 in the image forming apparatus. After the corresponding portion of the image forming apparatus rides over the shuttle surfaces 632 of each of the detent 622, the detent 622 are biased to return to the deployed positions and accordingly retain the toner cartridge 600 in the fully installed configuration within the image forming apparatus. As previously described, where decoupling of the toner cartridge 600 is specified in a similar manner to the cartridge 100, the cartridge 600 is operated, in one example, by the operator to accordingly provide force, movement or the like to the toner cartridge to overcome the bias otherwise provided by the detent 622 and the retaining surface 634. The force applied to the toner cartridge 600 overcomes this bias and deflects the detent 622 into the depressed position to facilitate removal of the toner cartridge from the image forming apparatus.

Figure 7A:
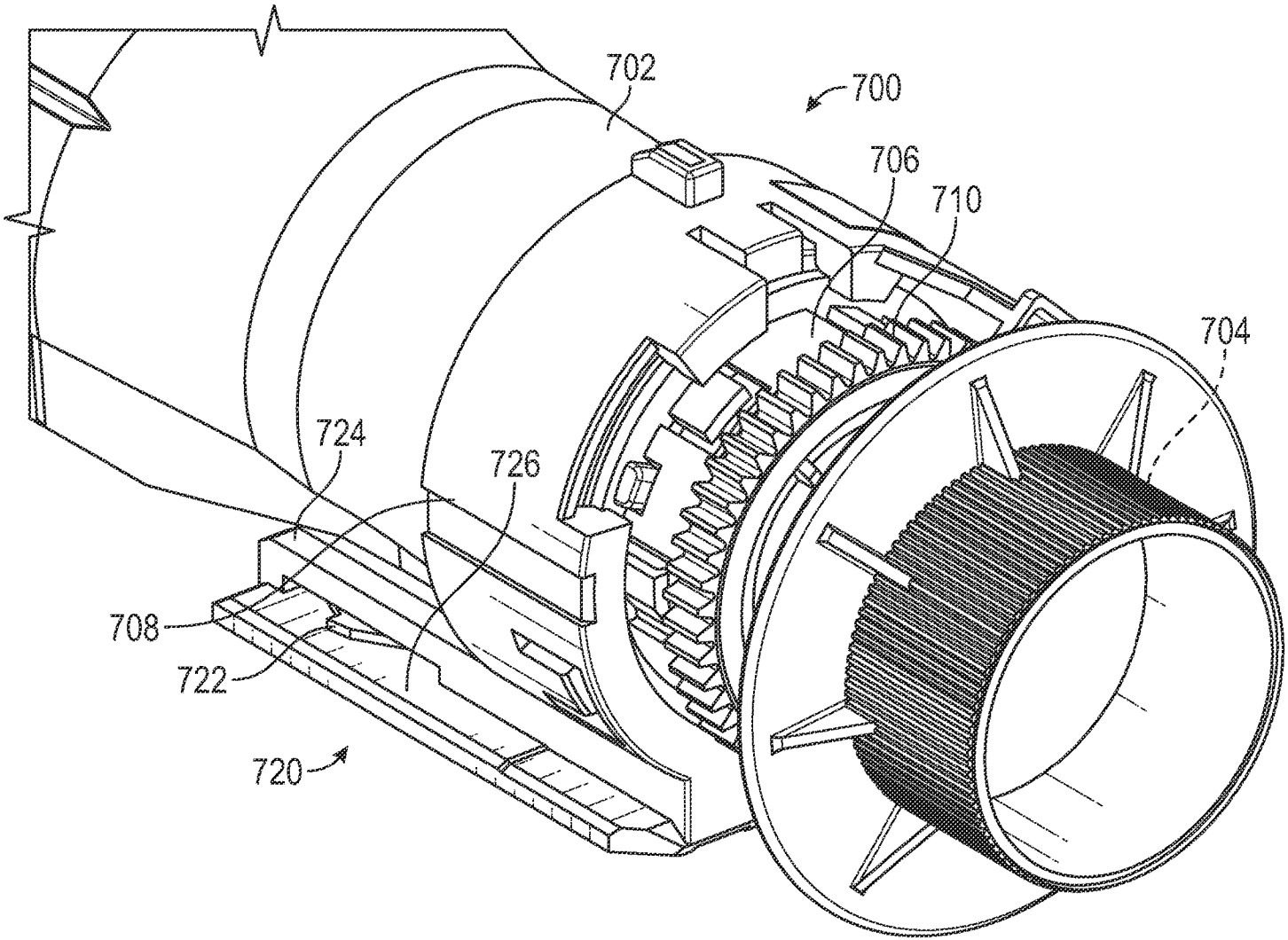
FIG. 7A is a detailed perspective view of an additional example of an interface mechanism.
Figure 7B:
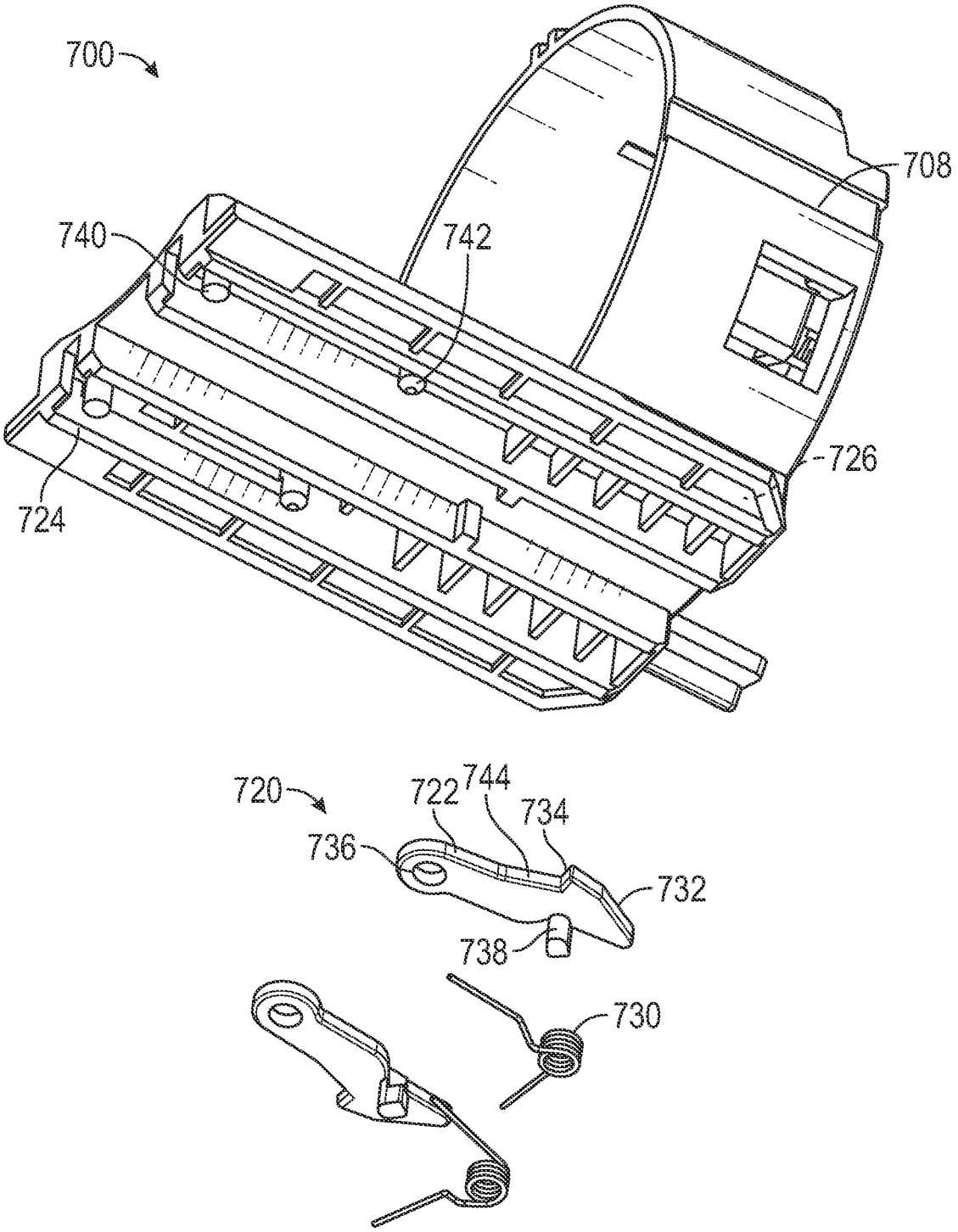
FIG. 7B is an exploded view of the interface mechanism of FIG. 7A and a portion of a cartridge body.
Figure 7C:
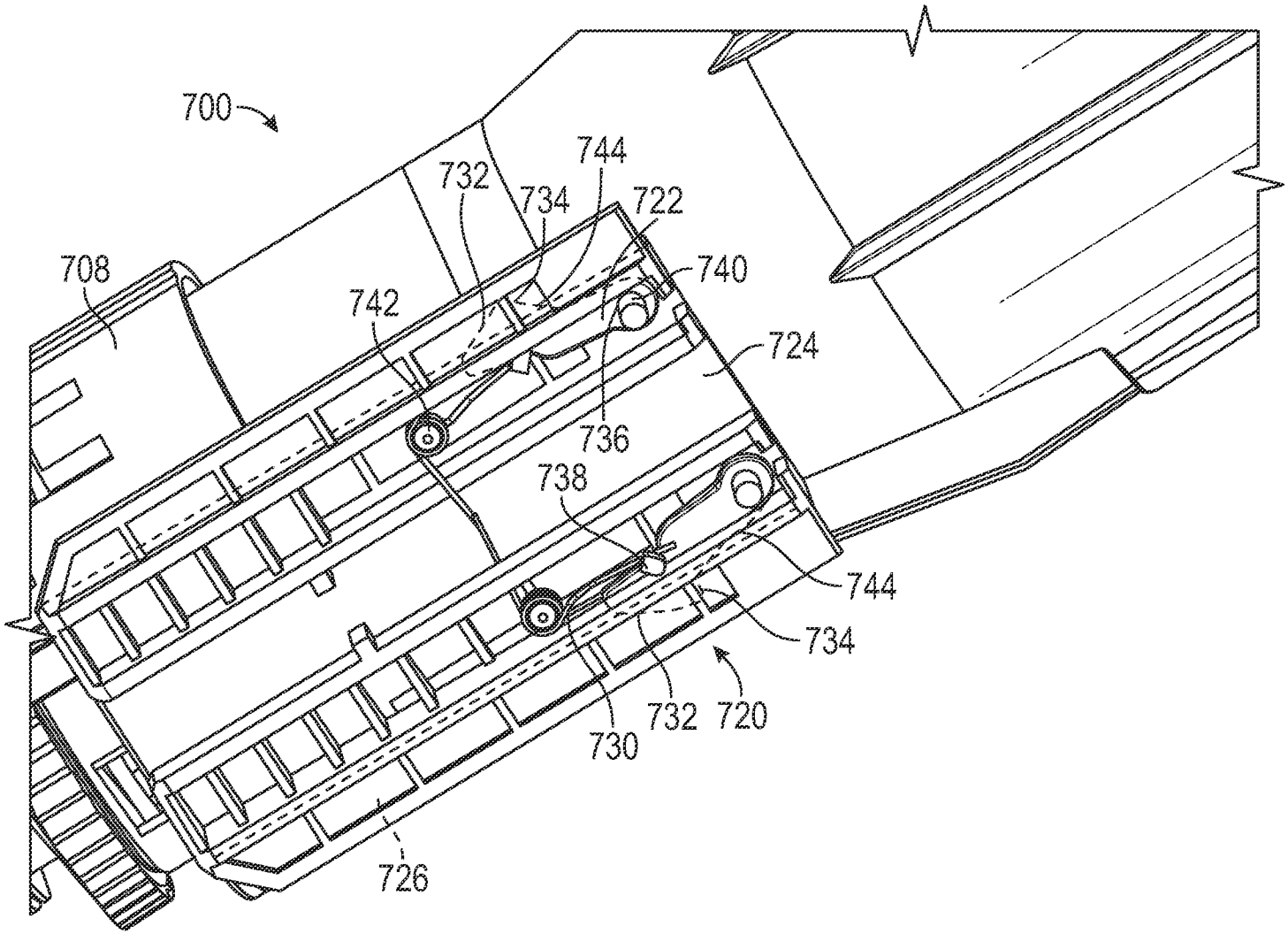
FIG. 7C is a perspective view of a portion of the interface mechanism of FIG. 7B assembled.

FIGS. 7A, 7B and 7C show another example of a toner cartridge 700. The toner cartridge 700 includes one or more features similar to previously described toner cartridges herein. For instance, the toner cartridge 700 includes a cartridge body 702 rotatably coupled relative to an interface collar 708. In this example, the cartridge body 702 further includes a cartridge cap 706, for instance, having one or more drive coupling 710 configured for coupling with corresponding drive features provided in an image forming apparatus. Rotation of the cartridge body 702 is accomplished with rotation of the drive coupling 710 transmitted to the cartridge body 702 to accordingly rotate the cartridge body 702 and toner therein. The interface collar 708, in this example, similar to previously described interface collars, remain static, for instance, through interfitting or engagement between one or more features of the interface collar 708 such as the interface mechanism 720, detent guide 726 or other corresponding features of the interface collar 708 that anchor the interface collar 708 in place relative to rotation of the cartridge body 702. Rotation of the cartridge body 702 moves toner toward the dispensing port 704 and accordingly facilitates the dispensing of toner, for instance, into a hopper, dispensing nozzle or the like extending through the dispensing port 704 (and in FIG. 7A concealed by a cap provided over the end surface of the cartridge cap 706).

Figure 8A:
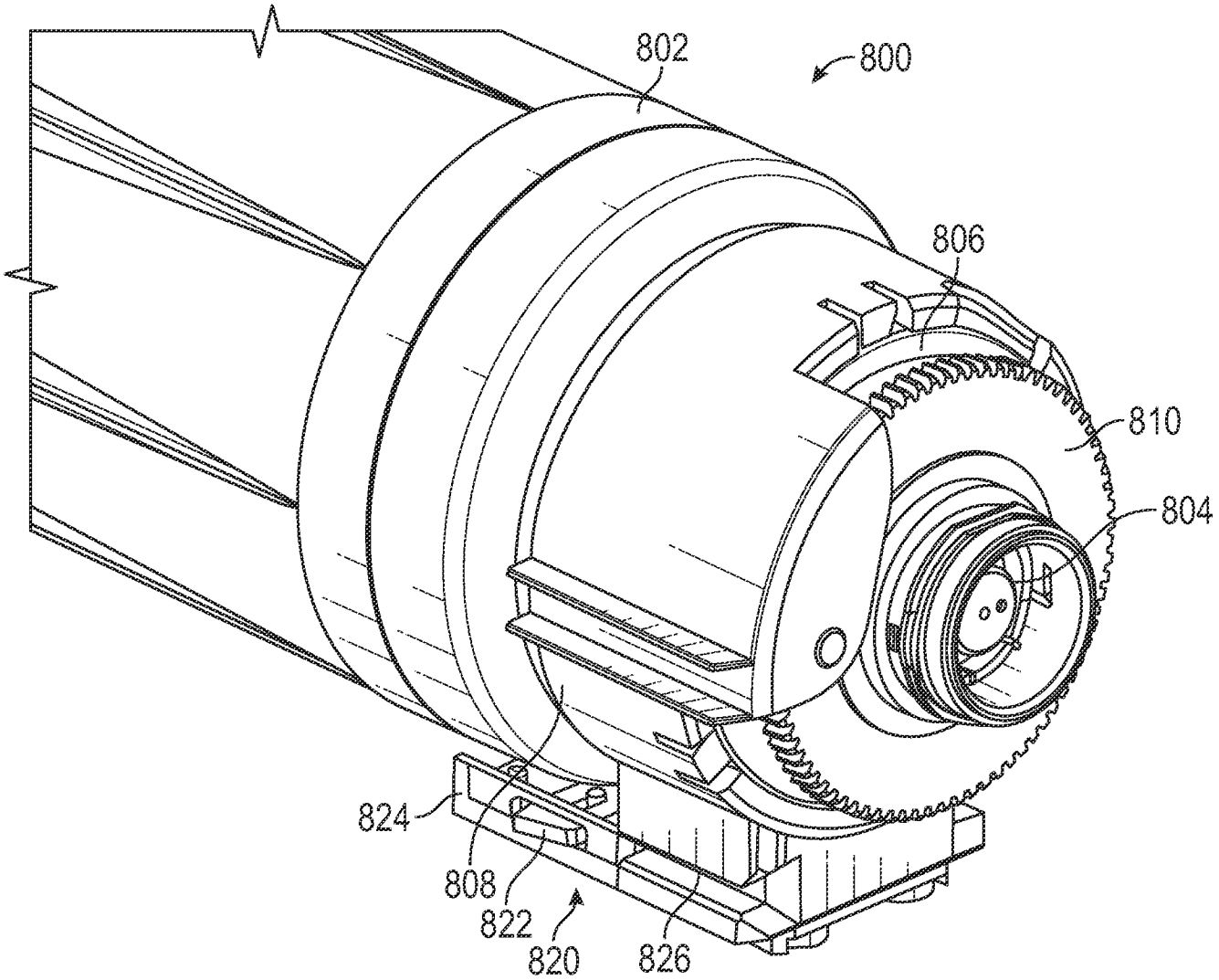
FIG. 8A is a detailed perspective view of a supplemental example of an interface mechanism.
Figure 8B:
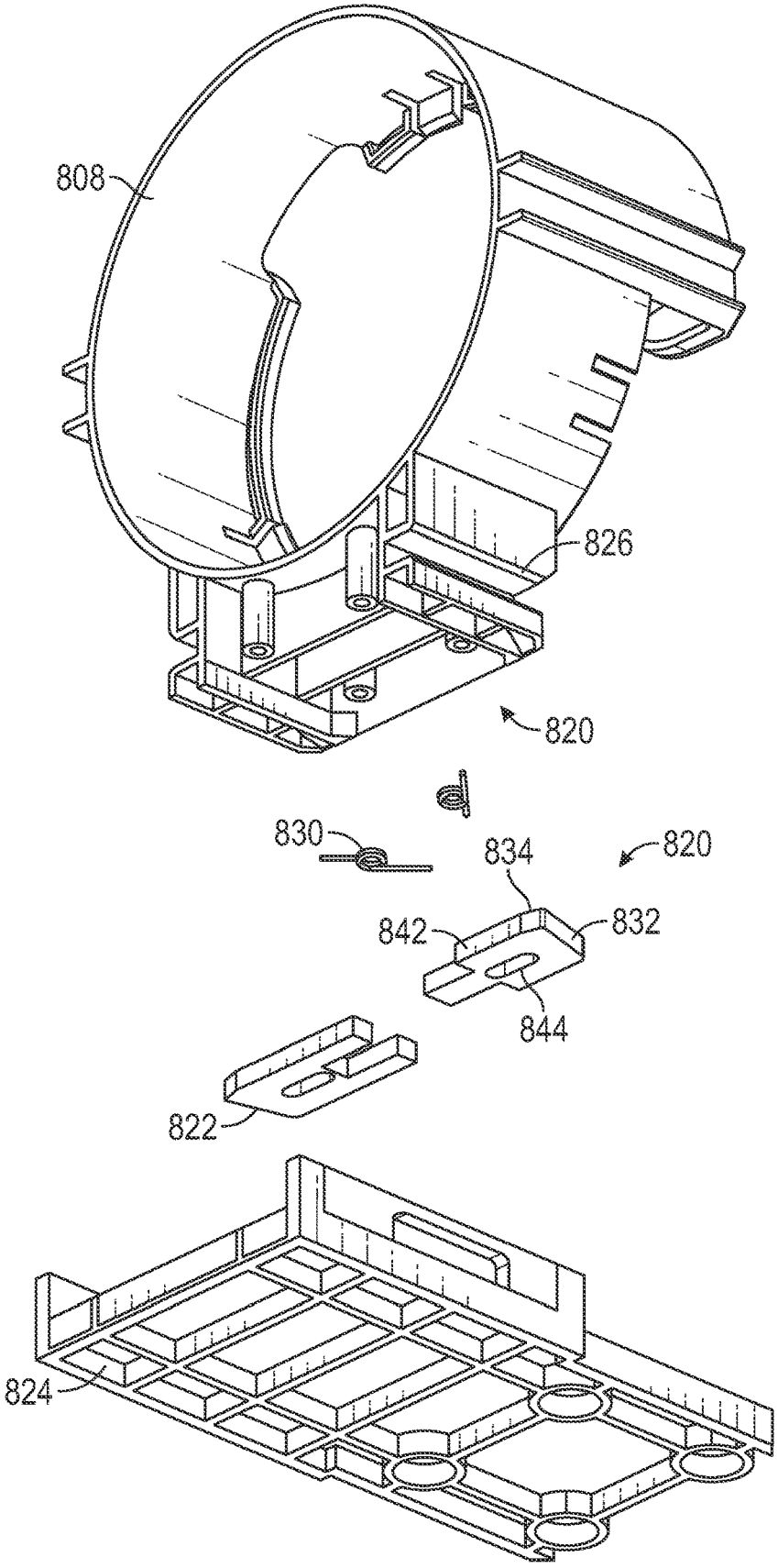
FIG. 8B is an exploded view of the interface mechanism of FIG. 8A and a portion of a cartridge body.
Figure 8C:
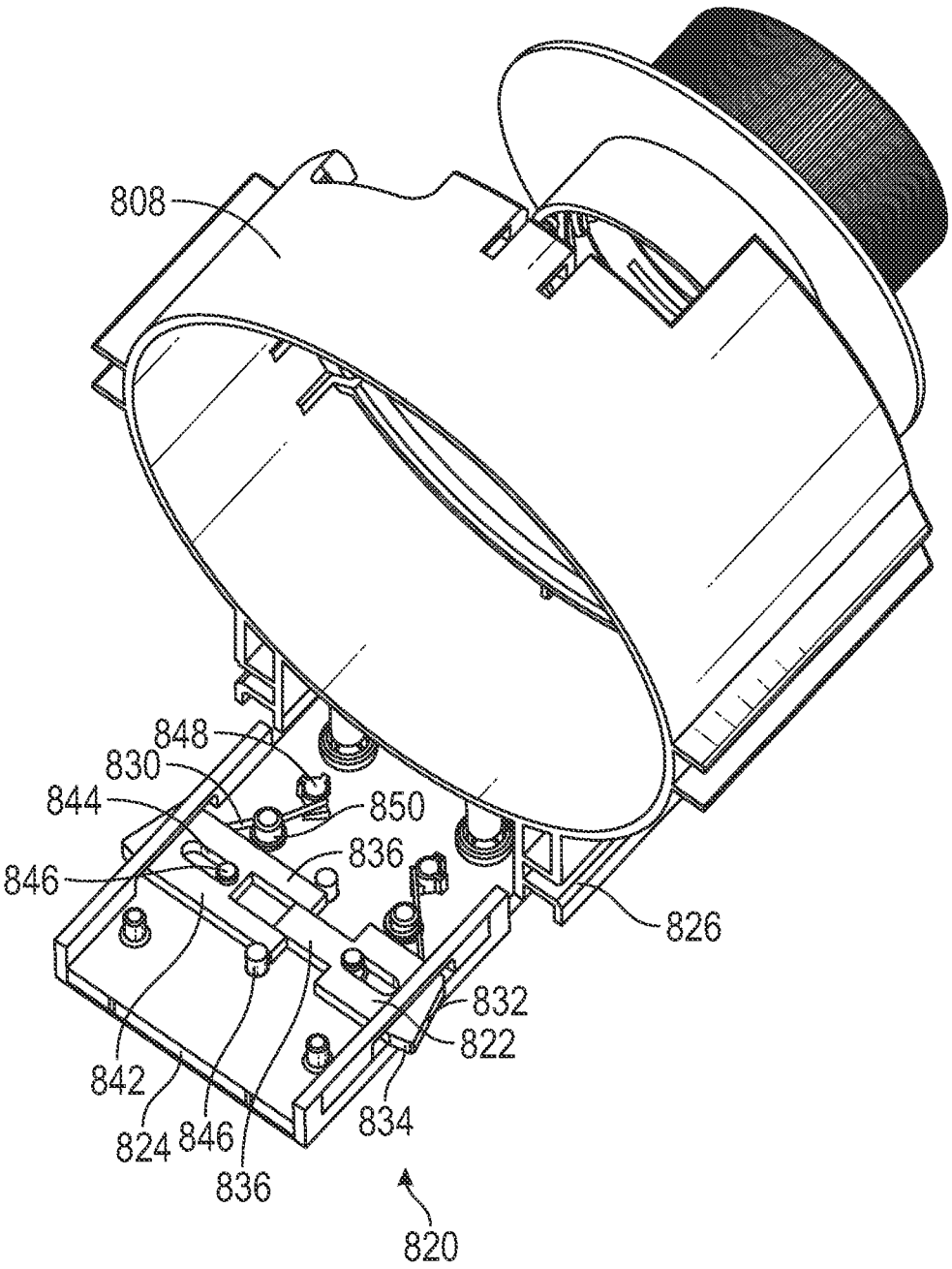
FIG. 8C is a perspective view of a portion of the interface mechanism of FIG. 8B assembled.

As further shown in FIG. 7A, the toner cartridge 700 includes another example of an interface mechanism 720. The mechanism 720 includes one or more detent guides 726, in this example, two detent guides 726 provided on differing portions of the interface collar 708 to accordingly align corresponding features of the image forming apparatus retaining alignment of those features with the detent 722. The detents 722, shown in FIG. 7A, are configured for depression relative to a deployed position shown in FIG. 7A. In one example, the detent 722 are rotatable in a similar manner to other examples provided herein. In another example, the detent 722, as well as the detents shown in FIGS. 8A-C are depressed or translated relative to the deployed position shown.

FIG. 7B shows a portion of the toner cartridge 700 including the interface collar 708 and one or more components of the interface mechanism 720 in an exploded configuration. As shown, the interface collar 708, in this example, includes a mechanism housing 724 configured to retain and arrange one or more features of the interface mechanism 720. For instance, in the example shown in FIG. 7B, the mechanism housing 724 includes a pivot pin 740 configured for coupling with the corresponding pivot hub 736 of the detent 722 to facilitate rotation of the detent 722 between the deployed and depressed positions. As further shown in FIG. 7B, a biasing element pin 742 is provided at a different location in the mechanism housing 724 to accordingly locate one or more biasing elements 730 in a spaced configuration relative to the pivot hub 736 and pivot pin 740.

As further shown in FIG. 7B, each of the detent 722, in this example, include a pivot hub 736 configured for coupling with the pivot pin 740 to accordingly facilitate rotation of the detent 722. As further shown in FIG. 7B, the detent 722 includes a shuttle surface 732 having a first taper and a retaining surface 734 having a lesser taper compared to the shuttle surface 732. As in previous examples, the shuttle surface 732 facilitates the passage of one or more features of the image forming apparatus over the detent 722 while the retaining surface 734 facilitates the retention of one or more features of the image forming apparatus in proximity to the retaining surface 734 to accordingly hold the toner cartridge 700 in a fully installed configuration with the image forming apparatus.

As further shown in FIG. 7B, the detent 722, in this example, includes a biasing element flange 738 configured to engage with one or more portions of a corresponding biasing element 730. In this example, with the biasing element 730 coupled at the biasing element pin 742 with the mechanism housing 724 a free end of the biasing element 730 is engaged with the biasing element flange 738 to accordingly load the detent 722 and bias the detent 722 into the deployed position shown, for instance, in FIG. 7A.

As further shown in FIG. 7B, the example of detents 722 shown include an additional surface, a decoupling surface 744, for instance, proximate to the retaining surface 734. The decoupling surface 744, in one example, includes a gradual taper relative to the steep surface or profile of the retaining surfaces 734. As shown in FIG. 7C, the decoupling surface 744, in one example, facilitates the deflection or movement of the detent 722 with the coupling of the toner cartridge 700 as specified.

FIG. 7C shows a detailed bottom perspective view of the toner cartridge 700 previously shown and described in FIGS. 7A, B. In this example, the detents 722 are shown installed along with the biasing element 730 with corresponding portions of the interface mechanism 720 including, in this example, the mechanism housing 724. For instance, the detent 722 having the pivot hub 736 is rotatably coupled at the pivot pin 740. Conversely, the biasing element 730 associated with the detent 722 is coupled at the biasing element pin 742 with the mechanism housing 724. In this example, the detent 722 and the biasing element 730 have a similar configuration to the previously shown detent 122 and biasing element 304 shown, for instance, in FIG. 4C. For instance, the biasing element 730 applies a bias at an opposed end of the detent 722 relative to the rotatable coupling between the pivot pin 740 and the pivot hub 736. For example, the biasing element 730 is loaded in a manner similar to that shown in FIG. 7C and the end coupled with the biasing element flange 738 biases the retaining surface 734 and shell surface 732 into the deployed position shown in broken lines in FIG. 7C. In this example, a portion of the mechanism housing 724 arrest further rotation of the detent 722, for instance, beyond the deployed position shown in FIG. 7C through engagement between the detent 722 and the mechanism housing 724 to accordingly prevent further deployment of the detent 722.

As further shown in FIG. 7C, the previously described decoupling surface 744, including an increased taper relative to the retaining surface 734, is shown partially extending beyond the detent guide 726 (shown with a dashed line in FIG. 7C). Accordingly, with decoupling movement of the toner cartridge 700, for instance, by withdrawal of the operator, in one example, the decoupling surfaces 744 of each of the detents 722 engage with the corresponding portions of the image forming apparatus to initiate movement of the detent 722, for instance, toward the depressed position to accordingly facilitate removal of the toner cartridge 700. For instance, the decoupling surface 744, in one example, engages with the corresponding surface of the image forming apparatus with movement of the toner cartridge 700 in a removing direction and begins rotation of the detent 722, for instance, in an inward manner to facilitate decoupling of the toner cartridge 700. In one example, the decoupling surface 744 sufficiently rotates the detent 722 to position the otherwise transverse retaining surface 734 at an angle relative to the image forming apparatus feature to thereby facilitate sliding engagement between the retaining surface 734 and the image forming apparatus to thereby facilitate easy removal of the toner cartridge 700. In contrast, without operator initiated movement of the toner cartridge 700, the retaining surface 734 remains in a transverse orientation shown, for instance, in FIG. 7C and readily engages with corresponding portions of the image forming apparatus to thereby retain the toner cartridge 700 in the fully installed configuration.

FIG. 8A is a perspective view of another example of a toner cartridge 800. In a similar manner to the previously described toner cartridges herein, the cartridge 800 includes a cartridge body 802 rotatably coupled, for instance, with an interface collar 808. In this example, the cartridge body 802 includes a cartridge cap 806 coupled with the remainder of the cartridge body 802. As further shown in FIG. 8A, a drive coupling 810 is provided with the cartridge cap 806 to accordingly rotate the cartridge body 802 and thereby deliver toner therein, for instance, along one or more of cuts, sling surfaces, baffles or the like to a dispensing port 804.

As further shown in FIG. 8A, another example interface mechanism 820 is provided with the toner cartridge 800. The interface mechanism 820 includes a detent guide 826 configured to align and guide one or more features of the image forming apparatus toward detents, for instance, the detent 822 shown in FIG. 8A and, in one or more examples, additional detents provided on the interface collar 808 as part of the toner cartridge 800.

As further shown in the figure, the interface mechanism 820 includes a detent 822 moveably coupled with a portion of the toner cartridge 800 including, for instance, the mechanism housing 824. In contrast to some of the other detents previously described herein, the detent 822, in the example provided in FIG. 8A, translates relative to one or more components of the toner cartridge 800 during installation of the toner cartridge 800 in the image forming apparatus.

FIG. 8B shows an exploded view of a portion of the toner cartridge 800. For instance, at the upper portion of the figure, an interface collar 808 is shown relative to a mechanism housing 824 and remaining components of the interface mechanism 820 including, but not limited to, a plurality of detents 822, 842 as well as biasing elements 830.

As shown in the exploded view the detents 822, 842 include, in this example, differing profiles, for instance, as described herein, one or more telescopic fittings are provided between the detents 822, 842, in one example, to facilitate the translational movement of the detents 822, 842 while at the same time maintaining their alignment, for instance, to maintain translational movement without buckling, decoupling or the like, for instance from the remainder of the interface mechanism 820.

As further shown in FIG. 8B, the biasing elements 830 are associated with each of the detents 822, 842. In a manner similar to some of the other embodiments provided herein, the biasing elements 830, as well as the detents 822, 842 are moveably coupled with other components of the interface mechanism 820 including, in one example, the mechanism housing 824. The moveable coupling of the detents 822, 842 with the toner cartridge, for instance, the mechanism housing 824, facilitates the delivery of one or more components of an image forming apparatus over corresponding shuttle surfaces 832 of each of the detents 822, 842. Additionally, each of the detents 822, 842 include retaining surfaces 834, for instance, having a decreased taper relative to the shuttle surfaces 832 to facilitate or retain the toner cartridge 800 in a fully installed configuration. As further shown in FIG. 8B, the detents 822, 842 optionally include one or more detent slots 844 to facilitate the guided movement of the detents 822, 842, for instance, during movement between deployed and depressed positions.

FIG. 8C shows another perspective view of a portion of the toner cartridge, including the interface collar 808 coupled with one or more other components of the interface mechanism 820, including the mechanism housing 824. As further shown in FIG. 8C, the detent guide 826 is shown in a leading configuration relative to the detents 822, 842. As previously described, the detent guides 826 align one or more features of the image forming apparatus during installation of the toner cartridge with the respective detents 822, 842. The alignment of these features with the detents 822, 842 ensures accurate installation of the toner cartridge 800 and retention of the toner cartridge, for instance, with one or more of the corresponding features of the image forming apparatus seized or captured behind the retaining surfaces 834.

As further shown in FIG. 8C, each of the detents 822, 842 are coupled with the mechanism housing 824. For instance, the detents 822, 842 partially project through corresponding orifices of the mechanism housing 824. Additionally, the detents 822, 842 are retained in position by one or more guide pins 846. In one example, the guide pins are provided on either side of one of the detents, such as the detent 842, to maintain the detent 842 and the interfit detent 822 in the position shown in FIG. 8C. Optionally, a telescopic fitting 836 is provided between the detents 822, 842 according to interleaved fingers, prongs or the like that guide the translation of the detents 822, 842.

In another example, and as shown in FIG. 8C, the detents 822, 842 are, in one example, loaded in a biased configuration, for instance, through the biasing elements 830. The biasing elements are, in this example, coupled with the toner cartridge at a biasing element pin 850. Opposed ends of the biasing elements are loaded, for instance, at a loading pin 848, positioned proximate to the interface collar 808. The opposed ends of the biasing elements 830 are received, coupled or fixed to corresponding portions of the detents 822, 842. Accordingly, the biasing elements 830 are provided in a loaded fashion that accordingly deploys each of the shuttle surfaces 832 and retaining surfaces 834 of the respective detents 822, 842 into the deployed position shown in FIG. 8C. Additionally, the guide pin 846 received in the detent slot 844 for each of the detents 822, 842 constrains movement of the detents 822, 842 in a manner similar to the detent slot 408 and guide pin 412 previously shown and described, for instance, in FIGS. 5A and 5B. For instance, the guide pin 846 and detent slot 844 cooperate for each of the detents 822, 842 to accordingly constrain motion of the detents 822, 842 and accordingly prevent or minimize striking of one or more components of the detents 822, 842 in a manner that would cause wear with the image forming apparatus or one or more other components of the toner cartridge 800.

Figure 9:
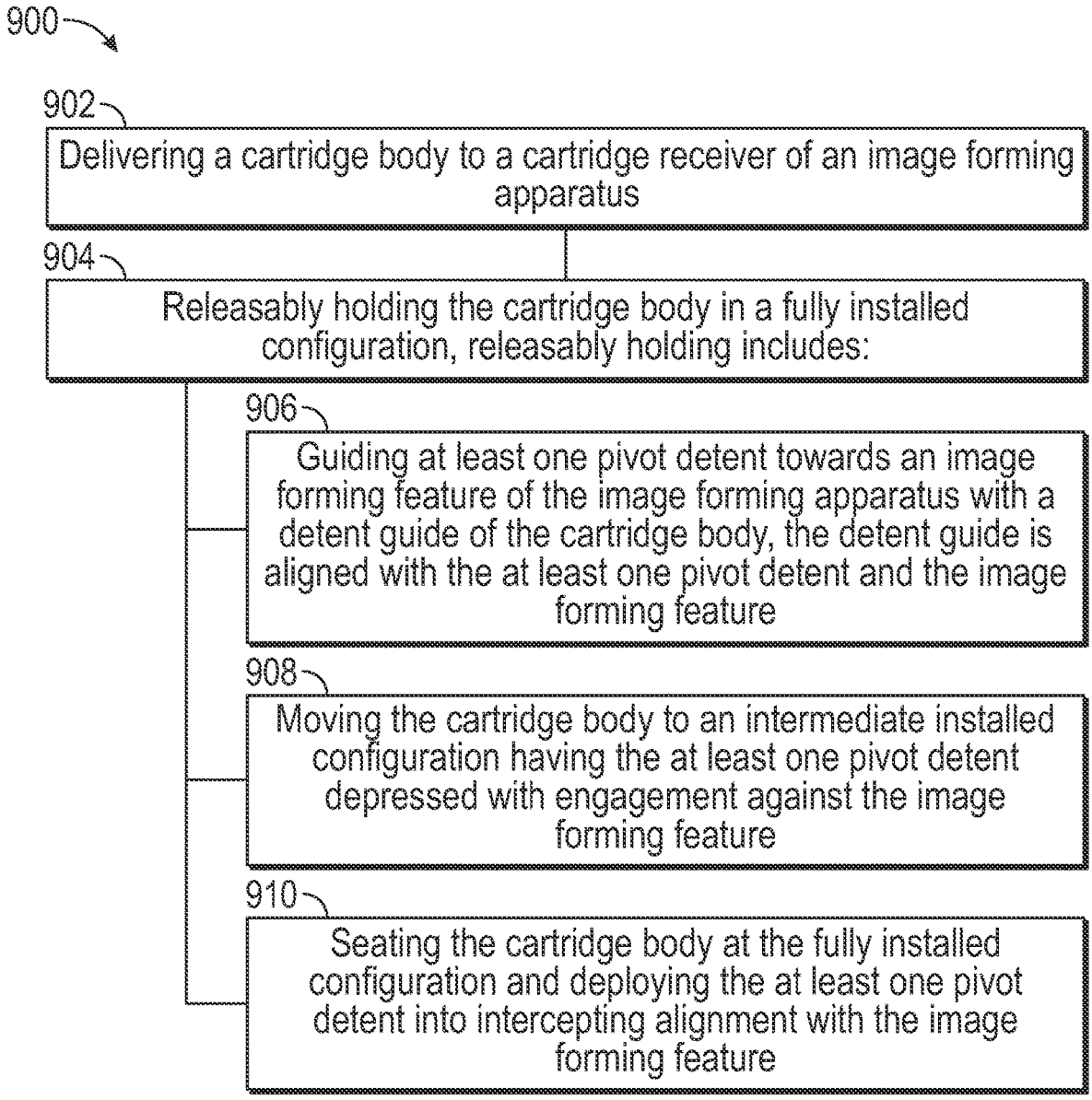
FIG. 9 is a block diagram showing one example of a method of installation of a toner cartridge.

FIG. 9 shows one example of a method 900 for installing a toner cartridge to an image forming apparatus. In describing the method 900, reference is made to one or more components, features, functions, steps or the like previously described herein. Where convenient, reference is made to the components, features, functions, steps or the like with reference numerals. Reference numerals provided are exemplary and are not exclusive. For instance, components, features, functions, steps or the like described in the method 900 include, but are not limited to, corresponding numbered elements provided herein, other corresponding features described herein (both numbered and unnumbered) as well as their equivalents.

At 902, the method 900 includes delivering a toner cartridge 100 to a cartridge receiver of an image forming apparatus. For example, the toner cartridge 100 having the cartridge body 102 is delivered to the cartridge receiver 501 of the image forming apparatus 500 and positioned therein as shown in FIGS. 5A-C. FIGS. 5A-C illustrate one example of the installation of a toner cartridge with an image forming apparatus. Optionally, the method 900 is similarly implemented with other example toner cartridges described herein.

At 904 the toner cartridge 100 is releasably held in a fully installed configuration, for instance shown in FIG. 5B. Releasably holding the toner cartridge 100 includes at 906 guiding at least one pivot detent 122 toward an image forming feature 502 of the image forming apparatus with a detent guide 126 of the toner cartridge 100 (see FIG. 5A). The detent guide 126 is in one example aligned with the at least one pivot detent 122 and the image forming feature 502. At 908, releasably holding the toner cartridge 100 includes moving the toner cartridge 100 to an intermediate installed configuration 504 having the at least one pivot detent 122 depressed with engagement against the image forming feature 502 (also shown in FIG. 5A).

At 910, releasably holding the toner cartridge 100 includes seating the toner cartridge at the fully installed configuration (shown in FIG. 5B) and deploying the at least one pivot detent 122 into intercepting alignment with the image forming feature 502. For example, a shuttle surface 402 of the pivot detent 122 promotes sliding movement and deflection of the pivot detent 122 relative to the image forming feature 502 (e.g., a ridge, rib, protrusion or the like) of the image forming apparatus 500. As the pivot detent 122 passes the intercepting feature (e.g., again a ridge or the like) of the image forming feature 502 the pivot detent 122 is deployed into the intercepting alignment shown in the FIG. 5B example.

Several options for the method 900 follow. In one example, the method 900 includes applying an ejection bias 510 to the toner cartridge 100 in an opposed direction to movement of the toner cartridge between the intermediate and fully installed configurations. Optionally, releasably holding the toner cartridge 100 in the fully installed configuration (see FIG. 5B) includes overcoming the ejection bias 510 with a retaining bias 512 of the at least one pivot detent.

In another example, the method 900 includes decoupling the toner cartridge 100 from the image forming apparatus 500. Decoupling includes applying a supplemental bias 514 to the toner cartridge 100 in the opposed direction (as shown in FIG. 5C). In one example, the supplemental bias 514 is less than the ejection bias 510. Decoupling further includes, in another example, unseating the toner cartridge 100 from the fully installed configuration (see FIGS. 5B, C) based on the supplemental bias 514 and the ejection bias 510 overcoming the retaining bias 512 of the at least one pivot detent 122.

In an additional example, releasably holding the toner cartridge 100 in the fully installed configuration includes maintaining alignment of the at least one pivot detent 122 with the image forming feature 502 of the image forming apparatus 500 with the detent guide 126 in at least one of the intermediate installed configuration (FIG. 5A) and the fully installed configuration (FIG. 5B). For example, the detent guide 126 maintains the pivot detent 122 in the intercepting alignment with the image forming feature 502 to enhance seating of the toner cartridge in the fully installed configuration 506. In another example, depressing and deploying the at least one pivot detent 122 includes rotating the at least one pivot detent 122 at a pivot hub 418.

Figure 10:
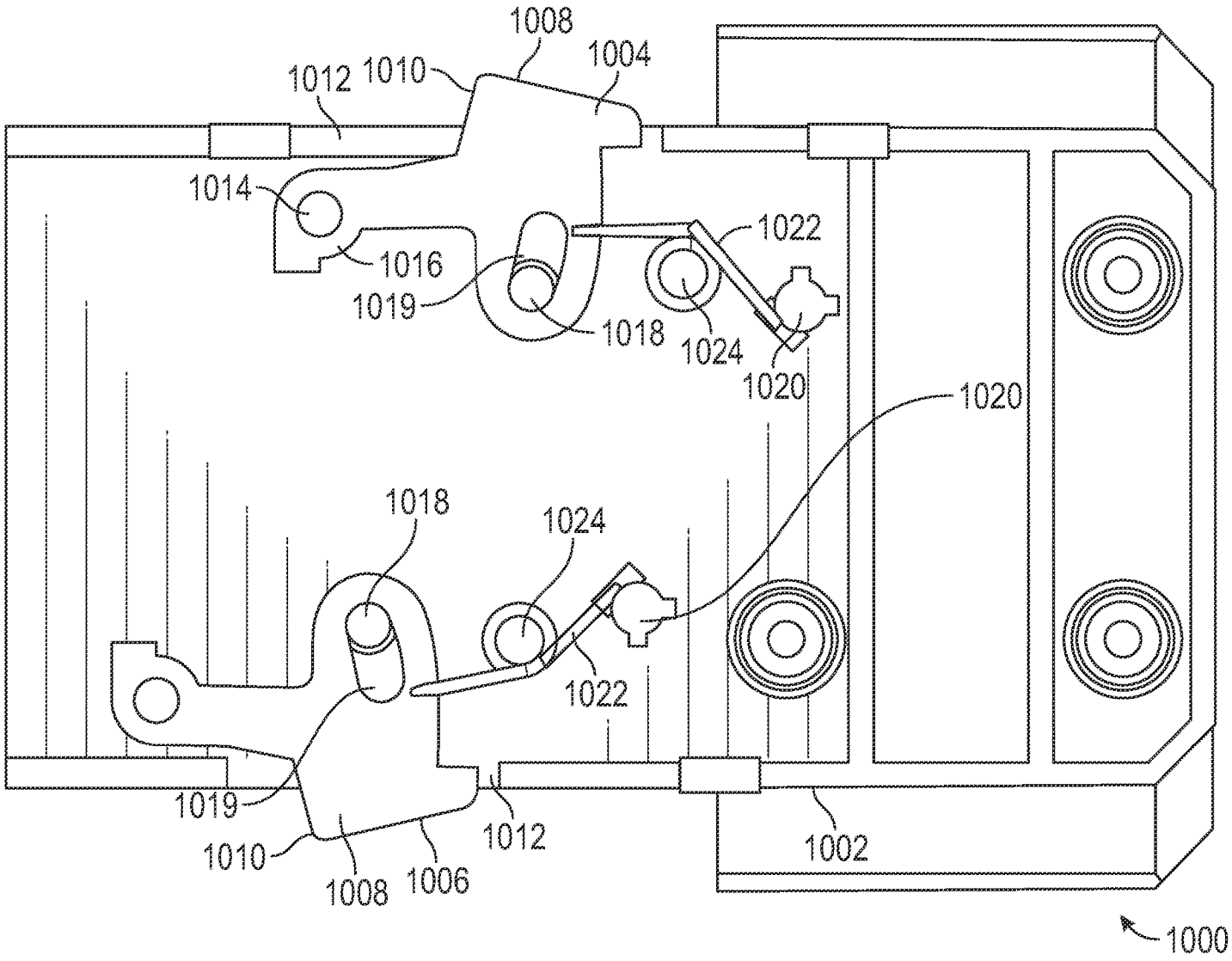
FIG. 10 is a schematic view of yet another example of an interface mechanism including staggered detents.

FIG. 10 is a schematic view of another interface mechanism 1000 having staggered detents. In the example shown in FIG. 10, the interface mechanism 1000 includes a leading detent 1004 and a trailing detent 1006. As described herein, the detents 1004, 1006 facilitate the installation and retention of a toner cartridge including the mechanism 1000 in different models of image forming apparatus (e.g., the models having image forming features in different staggered relative locations) as well as retention with multiple image forming features (e.g., 502) of an image forming apparatus having the features staggered or offset relative to each other.

Each of the detents 1004, 1006 include similar features to the previously described detents to facilitate engagement and retention with corresponding features of an image forming apparatus. For instance, the leading and trailing detents 1004, 1006 are in this example rotatably coupled with a pivot hub 1016 and a pivot pin 1014. In this example, the pivot pin 1014 is coupled with the mechanism housing 1002 of the interface mechanism 1000. Each of the detents 1004, 1006 protrude through optional detent slots 1012 of the mechanism housing 1000.

As further shown in FIG. 10, the leading and trailing detents 1004, 1006 include shuttle surfaces 1008 to permit depression of the detents and bias the associated retaining surfaces 1010 into intercepting alignment with the image forming features 502. In the example shown, the leading and trailing dents 1004, 1006 are biased toward the shown deployed configuration with biasing elements 1022. The biasing elements include leaf or torsion springs in one example, and as shown in this example are coupled with the mechanism housing 1002 with biasing element pins 1024 and loading pins 1020. The biasing elements pins 1024 position the biasing elements 1022, and the biasing elements 1022 are loaded with deflection between the biasing element pins 1024 and the loading pins 1020. Opposed portions of the biasing elements 1022 are coupled with the associated leading and trailing detents 1004, 1006 and bias the detents toward the deployed configuration shown in FIG. 10.

The leading and trailing detents 1004, 1006 optionally include associated deployment guides 1019 and guide pins 1018 received in the guides 1019. As previously described, the guide pins 1018 and deployment guides 1019 control movement of the detents 1004, 1006, and ensure deployment of the detents to the positions shown in FIG. 10 while constraining over-deployment that may otherwise cause damage to the detents with engagement to opposed image forming features (e.g., 502 in FIGS. 5A-C).

For installation to an image forming apparatus a toner cartridge including the interface mechanism 1000 is delivered to a cartridge receiver. The toner cartridge is positioned in the cartridge receiver, for instance by translation of the cartridge, and moved toward one or more image forming features including, but not limited to, ribs, ridges, projections or the like. In one example, a first model of the image forming apparatus includes one or more image forming features at positions corresponding to the leading detent 1004. Accordingly, as the toner cartridge having the interface mechanism 1000 is installed the leading detent 1004 is depressed with the associated image forming feature, and after the detent 1004 passes the feature the detent 1004 is biased to the deployed configuration and the retaining surface 1010 is in an intercepting alignment with the image forming feature of the first model to retain the toner cartridge in the image forming apparatus.

In a second example, the toner cartridge including the interface mechanism 1000 of FIG. 10 is installed in a second model of an image forming apparatus having image forming features at positions corresponding to the trailing detent 1006. As the toner cartridge is installed in the second model the trailing detent 1006 is depressed by the image forming feature and deploys to the deployed configuration shown in FIG. 10 with the retaining surface 1010 (associated with the tailing detent 1006) in intercepting alignment with the image forming feature, and the toner cartridge is fully installed (and retained). In these examples, the interface mechanism 1000 including the one or more detents, for instance the leading and trialing detents 1004, 1006, facilitates the installation of the toner cartridge in a plurality of image forming apparatuses having different configurations of image forming features that are engaged with the detents. In other examples, the interface mechanism 1000 includes a plurality of detents to permit installation of the associated toner cartridge in a corresponding plurality of image forming apparatuses.

In another example, the toner cartridge including the interface mechanism 1000 of FIG. 10 is installed in an image forming apparatus having image forming features at positions corresponding to each of the plurality of detents, such as the leading and trailing detents, 1004, 1006. As the toner cartridge is installed in the image forming apparatus both of the leading and trailing detents 1004, 1006 are depressed by corresponding image forming features that are staggered in correspondence with the detents. Each of the leading and trailing detents 1004, 1006 travel over the associated image forming features (e.g., ridges, ribs, protrusions or the like), for instance with the shuttle surfaces 1008. After traveling over the image forming features the leading and trailing detents 1004, 1006 deploy (e.g., according to bias from the biasing elements 1022) to position the retaining surfaces 1010 in intercepting alignment with the associated image forming features.

When decoupling of the toner cartridge having the interface mechanism 1000 is specified the toner cartridge is biased in a counter direction to the installation direction (e.g., backward) with one or more of an ejection bias provided by the image forming apparatus or a supplemental bias optionally provided by manual handling (pulling) by a machine user. One or both of the ejection bias or the supplemental bias overcomes a retaining bias of one or more of the detents 1004, 1006 aligned with corresponding image forming features. The one or more detents 1004, 1006 are depressed by engagement between the detents and the image forming feature according to the imbalance of bias (retaining bias overcome by ejection or supplemental bias) and the toner cartridge is readily decoupled from the image forming apparatus.

VARIOUS NOTES AND ASPECTS

Aspect 1 can include subject matter such as a toner cartridge comprising: a cartridge body having a dispensing port; an interface mechanism coupled with the cartridge body, the interface mechanism includes: at least one detent movably coupled with the cartridge body, the at least one detent includes: a retaining surface; a shuttle surface; and a bias element coupled with the detent; and at least one detent guide coupled with the cartridge body, the at least one detent guide includes a guide channel aligned with the retaining surface.

Aspect 2 can include, or can optionally be combined with the subject matter of Aspect 1, to optionally include wherein the retaining surface has a first taper and the shuttle surface has a second taper, and the second taper is greater than the first taper.

Aspect 3 can include, or can optionally be combined with the subject matter of one or any combination of Aspects 1 or 2 to optionally include wherein the interface mechanism includes a mechanism housing coupled with the cartridge body, the at least one detent is within the mechanism housing, and a portion of the at least one detent including the retaining surface and the shuttle surface projects from the mechanism housing.

Aspect 4 can include, or can optionally be combined with the subject matter of one or any combination of Aspects 1-3 to optionally include wherein the at least one detent is rotatably coupled with the cartridge body at a pivot hub.

Aspect 5 can include, or can optionally be combined with the subject matter of one or any combination of Aspects 1-4 to optionally include wherein the detent includes a deployment guide slidably coupled along a guide pin, and the deployment guide and the guide pin constrain rotation of the pivot detent between a depressed position and a deployed position.

Aspect 6 can include, or can optionally be combined with the subject matter of Aspects 1-5 to optionally include wherein the pivot hub is located proximate a first side of the deployment guide, and the bias element is coupled with the detent proximate a second side of the deployment guide, the second side opposed to the first side.

Aspect 7 can include, or can optionally be combined with the subject matter of Aspects 1-6 to optionally include wherein the guide channel is configured to maintain alignment between the retaining surface and a ridge of an image forming apparatus as the toner cartridge is installed between intermediate and fully installed configurations.

Aspect 8 can include, or can optionally be combined with the subject matter of Aspects 1-7 to optionally include wherein: in the intermediate installed configuration the shuttle surface depresses the at least one detent; and in the fully installed configuration the bias element deploys the retaining surface into intercepting alignment with the ridge of the image forming apparatus, and the retaining surface releasably holds the cartridge body in the fully installed configuration.

Aspect 9 can include, or can optionally be combined with the subject matter of Aspects 1-8 to optionally include the image forming apparatus having the ridge.

Aspect 10 can include, or can optionally be combined with the subject matter of Aspects 1-9 to optionally include wherein the at least one detent includes a first detent and a second detent; the first detent is movably coupled with the cartridge body at a leading position; and the second detent is movably coupled with the cartridge body at a trailing position relative to the leading position.

Aspect 11 can include, or can optionally be combined with the subject matter of Aspects 1-10 to optionally include a toner cartridge comprising: a cartridge body having a dispensing port; a dispensing shutter coupled with the dispensing port, the dispensing shutter having open and closed positions; at least one pivot detent rotatably coupled with the cartridge body, the at least one pivot detent includes: a retaining surface; a shuttle surface; and a bias element coupled with the pivot detent; at least one detent guide having a guide channel, the guide channel having a first end proximate the shuttle surface and a second end remote from the shuttle surface and proximate the dispensing port; and wherein the cartridge body is configured for installation in an image forming apparatus between intermediate and fully installed configurations: in the intermediate installed configuration a corresponding feature of the image forming apparatus is within the guide channel and the shuttle surface depresses the at least one pivot detent; and in the fully installed configuration the bias element deploys the retaining surface into intercepting alignment with the corresponding feature, and the retaining surface releasably holds both the dispensing port in alignment with a reservoir port of the image forming apparatus and the dispensing shutter in the open position.

Aspect 12 can include, or can optionally be combined with the subject matter of Aspects 1-11 to optionally include wherein the retaining surface has a first taper and the shuttle surface has a second taper, and the first taper is greater than the second taper.

Aspect 13 can include, or can optionally be combined with the subject matter of Aspects 1-12 to optionally include a mechanism housing coupled with the cartridge body, the at least one pivot detent is within the mechanism housing, and a portion of the at least one pivot detent including the retaining surface and the shuttle surface projects from the mechanism housing.

Aspect 14 can include, or can optionally be combined with the subject matter of Aspects 1-13 to optionally include wherein the at least one pivot detent is rotatably coupled with the cartridge body at a pivot hub.

Aspect 15 can include, or can optionally be combined with the subject matter of Aspects 1-14 to optionally include wherein the pivot detent includes a deployment guide slidably coupled along a guide pin, and the deployment guide and the guide pin constrain rotation of the pivot detent between: a depressed position in the intermediate installed configuration and a deployed position in the fully installed configuration.

Aspect 16 can include, or can optionally be combined with the subject matter of Aspects 1-15 to optionally include wherein the pivot hub is located proximate a first side of the pivot detent, and the bias element is coupled with the pivot detent proximate a second side of the pivot detent opposed to the first side.

Aspect 17 can include, or can optionally be combined with the subject matter of Aspects 1-16 to optionally include an interface collar rotatably coupled with the cartridge body, the interface collar includes: the at least one pivot detent; and the detent guide.

Aspect 18 can include, or can optionally be combined with the subject matter of Aspects 1-17 to optionally include wherein the at least one detent guide includes one or more guide flanges extending from proximate the dispensing port toward the at least one pivot detent.

Aspect 19 can include, or can optionally be combined with the subject matter of Aspects 1-18 to optionally include wherein the at least one pivot detent includes first and second pivot detents: the first pivot detent is proximate a first side of the cartridge body; and the second pivot detent is proximate a second side of the cartridge body different than the first side.

Aspect 20 can include, or can optionally be combined with the subject matter of Aspects 1-19 to optionally include wherein the at least one detent guide includes first and second detent guides: the first detent guide aligned with the first pivot detent; and the second detent guide aligned with the second pivot detent.

Aspect 21 can include, or can optionally be combined with the subject matter of Aspects 1-20 to optionally include wherein the at least one pivot detent includes a first pivot detent and a second pivot detent; the first pivot detent is rotatably coupled with the cartridge body at a leading position; and the second pivot detent is rotatably coupled with the cartridge body at a trailing position relative to the leading position.

Aspect 22 can include, or can optionally be combined with the subject matter of Aspects 1-21 to optionally include the image forming apparatus having the corresponding feature.

Aspect 23 can include, or can optionally be combined with the subject matter of Aspects 1-22 to optionally include a method for installing a toner cartridge comprising: delivering a toner cartridge to a cartridge receiver of an image forming apparatus; releasably holding the toner cartridge in a fully installed configuration, releasably holding includes: guiding at least one pivot detent toward an image forming feature of the image forming apparatus with a detent guide of the toner cartridge, the detent guide is aligned with the at least one pivot detent and the image forming feature; moving the toner cartridge to an intermediate installed configuration having the at least one pivot detent depressed with engagement against the image forming feature; and seating the toner cartridge at the fully installed configuration and deploying the at least one pivot detent into intercepting alignment with the image forming feature.

Aspect 24 can include, or can optionally be combined with the subject matter of Aspects 1-23 to optionally include applying an ejection bias to the toner cartridge in an opposed direction to movement of the toner cartridge between the intermediate and fully installed configurations; and wherein releasably holding the toner cartridge in the fully installed configuration includes overcoming the ejection bias with a retaining bias of the at least one pivot detent.

Aspect 25 can include, or can optionally be combined with the subject matter of Aspects 1-24 to optionally include decoupling the toner cartridge from the image forming apparatus, decoupling includes: applying a supplemental bias to the toner cartridge in the opposed direction, the supplemental bias less than the ejection bias; and unseating the toner cartridge from the fully installed configuration based on the supplemental bias and the ejection bias overcoming the retaining bias of the at least one pivot detent.

Aspect 26 can include, or can optionally be combined with the subject matter of Aspects 1-25 to optionally include wherein releasably holding the toner cartridge in the fully installed configuration includes maintaining alignment of the at least one pivot detent with the image forming feature of the image forming apparatus with the detent guide in at least one of the intermediate installed configuration and the fully installed configuration.

Aspect 27 can include, or can optionally be combined with the subject matter of Aspects 1-26 to optionally include wherein depressing and deploying the at least one pivot detent includes rotating the at least one pivot detent at a pivot hub. Each of these non-limiting aspects can stand on its own, or can be combined in various permutations or combinations with one or more of the other aspects.

The above description includes references to the accompanying drawings, which form a part of the detailed description. The drawings show, by way of illustration, specific embodiments in which the invention can be practiced. These embodiments are also referred to herein as "aspects" or "examples." Such aspects or example can include elements in addition to those shown or described. However, the present inventors also contemplate aspects or examples in which only those elements shown or described are provided. Moreover, the present inventors also contemplate aspects or examples using any combination or permutation of those elements shown or described (or one or more features thereof), either with respect to a particular aspects or examples (or one or more features thereof), or with respect to other Aspects (or one or more features thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Geometric terms, such as "parallel", "perpendicular", "round", or "square", are not intended to require absolute mathematical precision, unless the context indicates otherwise. Instead, such geometric terms allow for variations due to manufacturing or equivalent functions. For example, if an element is described as "round" or "generally round," a component that is not precisely circular (e.g., one that is slightly oblong or is a many-sided polygon) is still encompassed by this description.

The above description is intended to be illustrative, and not restrictive. For example, the above-described aspects or examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as aspects, examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The claimed invention is:

1. A toner cartridge comprising:
a cartridge body having a dispensing port;
an interface mechanism coupled with the cartridge body, the interface mechanism includes:
at least one detent movably coupled with the cartridge body, the at least one detent includes:
a retaining surface;
a shuttle surface; and
a bias element coupled with the detent; and
at least one detent guide coupled with the cartridge body, the at least one detent guide includes a guide channel aligned with the retaining surface.

2. The toner cartridge of claim 1, wherein the retaining surface has a first taper and the shuttle surface has a second taper, and the second taper is greater than the first taper.

3. The toner cartridge of claim 1, wherein the interface mechanism includes a mechanism housing coupled with the cartridge body;
the at least one detent is within the mechanism housing; and
a portion of the at least one detent including the retaining surface and the shuttle surface projects from the mechanism housing.

4. The toner cartridge of claim 1, wherein the at least one detent is rotatably coupled with the cartridge body at a pivot hub.

5. The toner cartridge of claim 4, wherein the detent includes a deployment guide slidably coupled along a guide pin, and the deployment guide and the guide pin constrain rotation of the of detent between a depressed position and a deployed position.

6. The toner cartridge of claim 5, wherein the pivot hub is located proximate a first side of the deployment guide, and the bias element is coupled with the detent proximate a second side of the deployment guide, the second side opposed to the first side.

7. The toner cartridge of claim 1, wherein the guide channel is configured to maintain alignment between the retaining surface and a ridge of an image forming apparatus as the toner cartridge is installed between intermediate and fully installed configurations.

8. The toner cartridge of claim 7, wherein:
in the intermediate installed configuration the shuttle surface depresses the at least one detent; and
in the fully installed configuration the bias element deploys the retaining surface into intercepting alignment with the ridge of the image forming apparatus, and the retaining surface releasably holds the cartridge body in the fully installed configuration.

9. The toner cartridge of claim 7 comprising the image forming apparatus having the ridge.

10. The toner cartridge of claim 1, wherein the at least one detent includes a first detent and a second detent;
the first detent is movably coupled with the cartridge body at a leading position; and
the second detent is movably coupled with the cartridge body at a trailing position relative to the leading position.

11. A toner cartridge comprising:
a cartridge body having a dispensing port;
a dispensing shutter coupled with the dispensing port, the dispensing shutter having open and closed positions;
at least one pivot detent rotatably coupled with the cartridge body, the at least one pivot detent includes:
a retaining surface;
a shuttle surface; and
a bias element coupled with the pivot detent;

at least one detent guide having a guide channel, the guide channel having a first end proximate the shuttle surface and a second end remote from the shuttle surface and proximate the dispensing port; and wherein the cartridge body is configured for installation in an image forming apparatus between intermediate and fully installed configurations:

in the intermediate installed configuration a corresponding feature of the image forming apparatus is within the guide channel and the shuttle surface depresses the at least one pivot detent; and in the fully installed configuration the bias element deploys the retaining surface into intercepting alignment with the corresponding feature, and the retaining surface releasably holds both the dispensing port in alignment with a intake nozzle of the image forming apparatus and the dispensing shutter in the open position.

12. The toner cartridge of claim 11, wherein the retaining surface has a first taper and the shuttle surface has a second taper, and the first taper is greater than the second taper.

13. The toner cartridge of claim 11 comprising a mechanism housing coupled with the cartridge body;

the at least one pivot detent is within the mechanism housing; and a portion of the at least one pivot detent including the retaining surface and the shuttle surface projects from the mechanism housing.

14. The toner cartridge of claim 11, wherein the at least one pivot detent is rotatably coupled with the cartridge body at a pivot hub.

15. The toner cartridge of claim 14, wherein the pivot detent includes a deployment guide slidably coupled along a guide pin, and the deployment guide and the guide pin constrain rotation of the pivot detent between:

a depressed position in the intermediate installed configuration; and a deployed position in the fully installed configuration.

16. The toner cartridge of claim 14, wherein the pivot hub is located proximate a first side of the pivot detent, and the bias element is coupled with the pivot detent proximate a second side of the pivot detent opposed to the first side.

17. The toner cartridge of claim 11 comprising an interface collar rotatably coupled with the cartridge body, the interface collar includes:

the at least one pivot detent; and the detent guide.

18. The toner cartridge of claim 11, wherein the at least one detent guide includes one or more guide flanges extending from proximate the dispensing port toward the at least one pivot detent.

19. The toner cartridge of claim 11, wherein the at least one pivot detent includes first and second pivot detents:

the first pivot detent is proximate a first side of the cartridge body; and the second pivot detent is proximate a second side of the cartridge body different than the first side.

20. The toner cartridge of claim 19, wherein the at least one detent guide includes first and second detent guides:

the first detent guide aligned with the first pivot detent; and the second detent guide aligned with the second pivot detent.

21. The toner cartridge of claim 11, wherein the at least one pivot detent includes a first pivot detent and a second pivot detent;

the first pivot detent is rotatably coupled with the cartridge body at a leading position; and the second pivot detent is rotatably coupled with the cartridge body at a trailing position relative to the leading position.

22. The toner cartridge of claim 11 comprising the image forming apparatus having the corresponding feature.

23. A method for installing a toner cartridge comprising:

delivering a toner cartridge to a cartridge receiver of an image forming apparatus; and releasably holding the toner cartridge in a fully installed configuration, releasably holding includes:

guiding at least one pivot detent toward an image forming feature of the image forming apparatus with a detent guide of the toner cartridge, the detent guide is aligned with the at least one pivot detent and the image forming feature;

moving the toner cartridge to an intermediate installed configuration having the at least one pivot detent depressed with engagement against the image forming feature; and seating the toner cartridge at the fully installed configuration and deploying the at least one pivot detent into intercepting alignment with the image forming feature.

24. The method of claim 23 comprising applying an ejection bias to the toner cartridge in an opposed direction to movement of the toner cartridge between the intermediate and fully installed configurations; and wherein releasably holding the toner cartridge in the fully installed configuration includes overcoming the ejection bias with a retaining bias of the at least one pivot detent.

25. The method of claim 24 comprising decoupling the toner cartridge from the image forming apparatus, decoupling includes:

applying a supplemental bias to the toner cartridge in the opposed direction, the supplemental bias less than the ejection bias; and unseating the toner cartridge from the fully installed configuration based on the supplemental bias and the ejection bias overcoming the retaining bias of the at least one pivot detent.

26. The method of claim 23, wherein releasably holding the toner cartridge in the fully installed configuration includes maintaining alignment of the at least one pivot detent with the image forming feature of the image forming apparatus with the detent guide in at least one of the intermediate installed configuration and the fully installed configuration.

27. The method of claim 23, wherein depressing and deploying the at least one pivot detent includes rotating the at least one pivot detent at a pivot hub.

* * * * *